US009433290B1

(12) United States Patent
Davis

(10) Patent No.: US 9,433,290 B1
(45) Date of Patent: Sep. 6, 2016

(54) WIRE SHELF EXTENSIONS

(71) Applicant: Norman Davis, Estero, FL (US)

(72) Inventor: Norman Davis, Estero, FL (US)

( * ) Notice: Subject to any disclaimer, the term of this patent is extended or adjusted under 35 U.S.C. 154(b) by 0 days.

(21) Appl. No.: 14/935,576

(22) Filed: Nov. 9, 2015

Related U.S. Application Data

(63) Continuation-in-part of application No. 14/625,389, filed on Feb. 18, 2015, now abandoned.

(51) Int. Cl.

| | |
|---|---|
| ***A47F 5/08*** | (2006.01) |
| ***A47F 5/00*** | (2006.01) |
| ***A47B 96/02*** | (2006.01) |
| ***A47B 47/02*** | (2006.01) |
| ***A47B 47/00*** | (2006.01) |
| ***A47B 45/00*** | (2006.01) |
| ***A47B 55/02*** | (2006.01) |
| ***A47B 57/58*** | (2006.01) |
| ***A47F 5/01*** | (2006.01) |
| ***A47F 3/14*** | (2006.01) |
| ***A47F 3/06*** | (2006.01) |
| ***A47F 5/16*** | (2006.01) |
| ***A47F 5/10*** | (2006.01) |
| ***A47F 5/13*** | (2006.01) |

(52) U.S. Cl.

CPC ..... *A47B 96/025* (2013.01); *A47B 45/00* (2013.01); *A47B 47/0058* (2013.01); *A47B 47/022* (2013.01); *A47B 55/02* (2013.01); *A47B 57/581* (2013.01); *A47B 96/021* (2013.01); *A47B 96/027* (2013.01); *A47F 3/06* (2013.01); *A47F 3/147* (2013.01); *A47F 5/0031* (2013.01); *A47F 5/0068* (2013.01); *A47F 5/01* (2013.01); *A47F 5/10* (2013.01); *A47F 5/13* (2013.01); *A47F 5/16* (2013.01)

(58) Field of Classification Search

CPC A47B 96/025; A47B 96/021; A47B 47/022; A47B 47/0058; A47B 46/005; A47B 45/00; A47B 9/005; A47B 1/00; A47B 47/00; A47B 53/00; A47B 55/02; A47B 55/00; A47B 57/00; A47B 57/30; A47B 57/58; A47B 57/581; A47B 65/00; A47B 65/10; A47B 65/15; A47B 96/02; A47B 96/027; A47B 96/028; A47F 5/0838; A47F 5/0869; A47F 5/10; A47F 5/132; A47F 5/16; A47F 5/13; A47F 5/0081; A47F 1/02; A47F 5/01; A47F 3/00; A47F 3/06; A47F 3/14; A47F 3/147; A47F 5/00; A47F 5/0018; A47F 5/0031; A47F 5/0043; A47F 5/0068; F25D 25/02; F25D 2325/023

USPC ..... 211/90.01, 90.02, 90.03, 88.02, 193, 211/106, 106.01, 181.1, 119.003, 175, 153; 108/90, 83, 102, 185, 180, 137, 59

See application file for complete search history.

(56) References Cited

U.S. PATENT DOCUMENTS

| | | | | | |
|---|---|---|---|---|---|
| 2,198,584 | A | * | 4/1940 | Swably | 211/119.007 |
| 2,956,689 | A | * | 10/1960 | Van Der Togt | 211/86.01 |
| 3,403,789 | A | | 10/1968 | LaMorte | |
| 3,598,064 | A | | 8/1971 | Stempel | |
| 3,675,781 | A | * | 7/1972 | Chamberlin | 211/11 |
| 3,765,634 | A | | 10/1973 | Stempel | |
| 4,036,369 | A | * | 7/1977 | Eisenberg | 211/88.02 |
| 4,077,522 | A | * | 3/1978 | Trubiano | 211/175 |

(Continued)

*Primary Examiner* — Jennifer E Novosad

(74) *Attorney, Agent, or Firm* — Edward K Welch, II; IP&L Solutions

(57) ABSTRACT

One- and two-part shelf extensions for expanding the depth of existing wire shelving.

13 Claims, 13 Drawing Sheets

(56) References Cited

U.S. PATENT DOCUMENTS

| | | | | | |
|---|---|---|---|---|---|
| 4,155,312 | A | * | 5/1979 | Thorkildson | 108/137 |
| 4,267,931 | A | * | 5/1981 | Belotta | 211/153 |
| 4,316,593 | A | | 2/1982 | Miner | |
| 4,318,487 | A | | 3/1982 | McCarthy | |
| 4,374,498 | A | | 2/1983 | Yellin | |
| 4,437,572 | A | * | 3/1984 | Hoffman | 211/119.003 |
| 4,553,523 | A | * | 11/1985 | Stohrer, Jr. | 126/9 B |
| 4,624,376 | A | | 11/1986 | Bertram | |
| 4,646,658 | A | | 3/1987 | Lee | |
| 4,669,692 | A | | 6/1987 | Mastrodicasa | |
| 4,781,349 | A | | 11/1988 | Remmers | |
| 4,825,504 | A | | 5/1989 | Camilleri | |
| 5,133,463 | A | * | 7/1992 | Merl | 211/190 |
| 5,170,897 | A | * | 12/1992 | Wentworth | 211/181.1 |
| 5,398,824 | A | * | 3/1995 | Wolff et al. | 211/88.04 |
| 5,405,026 | A | | 4/1995 | Lee | |
| 5,411,146 | A | * | 5/1995 | Jarecki et al. | 211/59.2 |
| 5,450,971 | A | * | 9/1995 | Boron et al. | 211/134 |
| 5,584,405 | A | * | 12/1996 | Tunzi | 211/153 |
| 5,758,851 | A | | 6/1998 | Remmers | |
| D413,218 | S | * | 8/1999 | Doty | D6/675.5 |
| 6,016,928 | A | * | 1/2000 | Cothran et al. | 211/183 |
| 6,161,708 | A | * | 12/2000 | Myler | 211/90.02 |
| 6,273,276 | B1 | * | 8/2001 | Upton et al. | 211/59.2 |
| 6,341,704 | B1 | * | 1/2002 | Michel, Jr. | 211/181.1 |
| 6,357,609 | B1 | * | 3/2002 | Van Noord et al. | 211/90.02 |
| 7,182,210 | B2 | * | 2/2007 | Metcalf | 211/175 |
| 7,293,665 | B1 | * | 11/2007 | Hardy et al. | 211/153 |
| 2002/0170870 | A1 | * | 11/2002 | Callis | 211/119.003 |
| 2002/0178664 | A1 | * | 12/2002 | Dykhoff | 52/220.8 |
| 2004/0045920 | A1 | * | 3/2004 | Remmers | 211/153 |
| 2004/0149668 | A1 | * | 8/2004 | Fann et al. | 211/74 |
| 2007/0108146 | A1 | * | 5/2007 | Nawrocki | 211/119.003 |

* cited by examiner

WIRE SHELF EXTENSIONS

RELATED APPLICATIONS

The present patent application is a continuation-in-part of pending U.S. patent application Ser. No. 14/625,389 filed on Feb. 18, 2015 entitled "Residential Shelf Widener."

FIELD OF THE INVENTION

The present application is directed to simple, one- and two-part shelf extensions by which the depth of wire shelving, particularly mounted wire shelving, most especially wall mounted wire shelving, is easily and readily expanded.

BACKGROUND

Typical mountable wire shelving is comprised of two sets of a multitude of parallel wires, one set transverse, generally perpendicular, to and overlaying the other. The first set of wires is the structural or support wires which form the framework for the shelf, providing rigidity and torsional strength to the shelf. The second set of wires is the stringer wires which are transverse to and bonded/welded to the support wires, typically in a perpendicular orientation. The stringer wires form the upper surface of the shelves and serve as the support surface upon which items are placed in use. Typically, the support wires are of a greater diameter or width than the stringer wires, generally having a diameter or width of 150% to 400% or more of the diameter of the stringer wires.

Wire shelving is produced in continuous lengths of defined widths or depth of 12, 16, 18 and 20 inches. As a consumer product, wire shelving is typically sold as stock items of predefined lengths, e.g., 6 or 12 feet, which the installer then cuts to size. Wire shelving may be planar or have an "L" shaped cross-section along its width. Planar shelves have a linear cross-section and are characterized as having a plurality of support wires which run the length of the shelf, parallel to the mounting surface with a first support wire defining the front edge of the shelf, a second support wire defining the back edge of the shelf, and, optionally, though typically, one or more intermediate support wires there between. For example, a planar shelf having a 6 inch depth will typically comprise just the first and second support wires without an intermediate support wire whereas a planar shelf having a 12 inch depth or more will typically have one or more intermediate support wires which may be at or near the mid-point between the two edge support wires and/or aligned closer to the front edge support to provide additional torsional stability to the shelf under load. The stringer wires are likewise evenly spaced, perpendicular to the support wires and bonded or welded thereto, in either a loose mesh format, typically a 1 inch or so separation, or in a tight mesh format, typically a ½ inch or so spacing.

The more common wire shelving has an "L" shape cross-section where the back of the "L" corresponds to the shelf support surface whose length defines the depth of the shelf and whose construction mimics that of the planar shelf, as described above. The foot of the "L" corresponds to a front edge portion which is typically perpendicular to the shelf support surface and defined by the first or front edge support wire of the planar surface and another support wire parallel to and spaced from said first support wire, the spaced support wire. The front edge portion will typically have a height, i.e., the distance between the first support wire and the spaced support wire, of 3 inches or less, more commonly 2 inches or less. In some embodiments, the first and spaced support wires are connected by spaced rods or wires or equivalent elements which overlay the two or lie in the same plane as the two support wires. Alternatively, the stringer wires of the surface of the shelf are simply extended beyond and bent over the front support wire ending at the spaced support wire. The stringer wires of the "L" shaped shelves, like those of the planar shelf, are also of a loose or tight mesh construction. Finally, while the first, second and intermediate support wires of the planar support portion of the shelf may be in the same configuration as in the planar shelf itself, alternate configurations are also used depending upon the intended end-use of the shelving. Specifically, in addition to or in substitution for the support wires in the midpoint or mid-section of the planar shelf portion, one or more additional coplanar support wires are added parallel to and spaced from, but near, the front edge or second support wire. These wires add additional support and integrity to the shelf near the front edge of the shelf which is important for shelves with anticipated heavy loads, especially heavy loads towards the front of the shelf.

Owing to their simplicity and low cost, wire shelving has been a staple of consumers in installing shelving to pantries, closets, storage areas, etc. Along with the adoption of such shelving, a number of modifications and advances have been made for improved mounting and for allowing adjustments in the placement and size of the wire shelving. For example, Bertam (U.S. Pat. No. 4,624,376) discloses wire shelves wherein the vertical distance between shelves can be adjusted through the use of shelf supports secured to a wall or vertical mounting surface, which supports have a plurality of spaced slots for receiving tabs of a plurality of brackets which, in turn, support the shelf. Mastrodicasa (U.S. Pat. No. 4,669,692) employs support brackets that incorporate a slide element such that the shelf supported by the brackets may be extended and retracted to make items on the shelf more accessible.

While much of the art for adjustable shelves is directed to options for designing the shelf orientation and/or facilitating access to items on the shelf, several developers have addressed the need for adjusting shelf space. For example, Metcalf (U.S. Pat. No. 7,182,210) provides for adjustable shelving wherein the length of the shelf is extended through the use of retractable extension shelf units which pull out from the ends of the shelf. Lee (U.S. Pat. No. 4,644,6658) increases the depth of the shelf through the combined use of slidable bracket supports and accordion-like hinged surface panels. Here, as one extends the shelf along the brackets, the accordion-like segments lie flat and provide additional shelf space. In reverse, as one retracts the shelf or pushes the shelf back along the slide, the accordion-like segments fold up. While effective, the shelving of Lee is complex and expensive with limited expansion capability.

Finally, Merl (U.S. Pat. No. 5,133,463) provides a two-piece shelf/bin assembly wherein the two pieces interconnect, with several connection points, to allow one to adjust the depth of the shelf/bin. Unfortunately, the design and construction as taught in Merl does not provide a planar shelf surface: thus, items placed on the shelf can tip over. Additionally, Merl requires that the shelf be emptied prior to making adjustments in the depth. Most critically, the number of possible configurations, hence depth adjustments, of the Merl shelf is limited by the number of intermediate support wires. If only one, then the shelf has just two configurations, that with and that without the extension. In this regard, Merl offers no or very limited versatility, especially if it is to be used with generally available wire shelving.

Thus, while improvements and advancements have been made towards making wire shelving more versatile to accommodate individual needs, especially in closet and pantry design, etc., there is still a need for more versatile and self-supporting shelf extensions for wire shelving.

Similarly, there is still a need for shelf depth extensions that provide and allow for a coplanar or substantially coplanar surface with the existing shelving.

There is a need for shelf depth extensions that can be adjusted to multiple depths: most especially where the adjustment can be made without the need to remove the contents from the shelf.

Furthermore, there is still a need for low-cost, simple shelving having adjustable depths: most preferably extension shelving of one piece and two-piece design which do not require tools for installation and which can be installed by individuals of even the most primitive of DIY skill sets.

Finally, there is a need for universal shelf extensions that are suitable for use with wire shelving of all or most all manufacturers and designs.

SUMMARY

The present teaching provides for simple one- and two-piece wire shelf extensions comprising support wires and stringer wires, similar to or the same as those used in the construction of the wire shelving to which the extension is to be attached. The present teaching also provides for connector elements or brackets by which standard commercial stock shelving is added to existing shelving to extend the shelf depth without the need for additional support, e.g., braces, wall mounts, etc.

According to a first embodiment of the present teaching, the shelf extensions are self-supporting, single-unit shelf elements comprising a plurality of support and stringer wires, again with the stringer wires overlaying the support wires and forming the support surface of the shelf extension, wherein the stringer wires extend from one support wire, the front edge extension support wire, to a second extension support wire, the back extension support wire, with or without additional intermediate extension support wires, provided that at least two of the extension stringer wires have extended segments that a) extend past the second extension support wire a distance that is the same as the width of the shelf to which it is to be attached or, if the shelf contains one or more intermediate support wires, a distance that is at least as great as the distance from the front support wire to the nearest intermediate support wire and b) optionally, though preferably, have at least one "U" or "V" shaped cup or recess at the end thereof and/or along the length thereof that are intended to accept a support wire of the wire shelving to which it is to be attached.

According to this first embodiment, the extension is attached by sliding the stringer wire extended segments over the first or front edge support wire and between the stringer wires of the existing shelf until the cup or recess or one of the cups or recesses, as appropriate, engages and accepts that intermediate support that coincides with the added depth of shelf desired. Where the length of the extended segments of the extension stringer wires allow, one can readily adjust the extent to which the width of the shelf in increased by simply tipping the extension to disengage the support wire from the extended segment or, if present, the cup or recess of the extended segment while advancing and/or retracting the shelf extension until the desired depth of shelf is attained or, again if present, the cup or, if multiple cups or recesses, at least one of the cups or recesses corresponds in location to the same or another support wire that provides for the newly desired shelf depth.

According to a second embodiment of the present teaching there is provided a two-piece shelf extension comprising a shelf extension element as provided in the first embodiment in combination with a separate rod or wire element, which may be of the same length and diameter as the extension support elements provided, however, that the "U" or "V" shaped shaped cups or recesses must be present in the stringer wire extended segments. Here the diameter of the separate rod is such that it is capable of being accepted by the cup(s) and/or recess(es) in the stringer wire extended segments and of a length to capture a sufficient number of stringer wire extended segments to provide a stable shelf extension.

According to this second embodiment, the shelf extension is installed in the same manner as is the shelf extension of the first embodiment, but here the separate rod or wire is inserted into the cup or recess after the extension stringer wire extended segments are inserted between the stringer wires of the shelf and below the plane of the shelf so that the separate rod is held between the stringer wire extended segments and the underside of the stringer wires of the shelf. The shelf depth may simply be adjusted to the desired total depth by further inserting or retracting the shelf extension along the plane of the shelf. At most a slight tipping may be necessary if, in making the adjustment, the separate wire or rod is impeded by a support wire of the shelf in which case one merely tips the extension upward so that the wire or rod is able to pass the impeding support wire.

According to a third embodiment of the present teaching there is provided a one-piece extension to be used with an "L" cross-sectioned wired shelf. Though this allows for the construction of a stepped shelf where the shelf extension sits higher than the shelf surface of the existing shelf, most preferably, the shelf extension of this third embodiment is used with "L" cross-sectioned wire shelving where the foot of the "L" extends downward towards the floor such that there is no front edge portion of the shelf extending above the plane of the shelf defined by stringer wires. In this embodiment the shelf extension is similar to that of the first embodiment, at least with respect to its fore end; however, in this instance the stringer wire extended segments extend past the second extension support wire and then bend at a right angle and continue to extend a distance that is that same as or slightly greater than the distance between the front edge support wire and the spaced support wire of the front edge portion of the shelf to which the shelf extension is to be connected. The bend in the stringer wire extended segment is at least as far removed from the second extension support wire as will allow the front edge support wire of the existing shelf to fit between the bent stringer wire extended segment at the point of the bend and the second or back extension support wire. Preferably the bend is at a point that is at least one-half inch, more preferably about one inch from the second extension support wire. Optionally, though preferably, the free end of the stringer wire extended segment is bent to provide a "J" shape to the bent portion where the foot of the "J" is positioned so that it will allow the spaced support wire of the foot of the existing shelf to sit in curve of the "J". Preferably, especially to allow for universal use with the product of multiple manufactures, the length of the bent portion of the stringer wire extended segment is of a length that matches the largest spacing between the front edge support and the spaced support of commercial product. As an option, the upper surface of the bent portion of the extended segment may have a plurality of "U" or "V" shaped cups or recesses that coincide with the spacing of the first and spaced support wires of other commercial products. As with the first embodiment, it is not necessary that all extension stringer wires of the shelf extension have the extended segment. Rather, it is only necessary that a sufficient number of the extension stringer wires have an extended segment as will provide sufficient strength to hold up and provide stability to the shelf extension, especially in consideration of the added weight of whatever is to be placed on the shelf. Alternatively or in addition, again as with the first embodiment, some or all of those stringer wires of the extension that have the extended segment may be of a larger diameter wire than the other stringer wires so as to ensure adequate support and strength.

The shelf extension of this embodiment is applied by inserting the stringer wire extended segments between the stringer wires of the planar surface of the wire shelf behind the front edge support wire of the shelf and lowering the extension at an angle so that the stringer wire extended segments fall in front of the spaced support wire. Once the shelf extension is inserted sufficiently so that the front support wire of the existing shelf falls in the bend of the extended segment, the front edge of the shelf extension is then lowered so that the upper surface of the free end of the extended segment rests against the outer surface of the spaced support wire.

According to a fourth and a fifth embodiment of the present teaching there are provided shelf extension brackets, generally a single piece, having an aft section and a fore section wherein the aft section mimics the design and ultimately the purpose of the stringer wire extended segments of the first and third embodiments, respectively, and the fore section defines a seat for a wire shelf segment: the seat, in use, extending across the width of the shelf segment. The brackets of the fourth and fifth embodiments may be made of a composite material, a molded plastic or a formed metal strip or rod/wire. Preferably, the brackets are formed of a metal rod of the same or a similar diameter to the support wires of the wire shelf and have a diameter or thickness that is at least as great as the thickness or diameter of the support wires of the wire shelf segments, preferably 1× to 3× or more the thickness or diameter of the wire shelf segments.

In the fourth embodiment, the aft section of the shelf extension bracket may have the shape, length, design and elements of any of the stringer wire extended segments of the first embodiment. Typically, because the extension brackets are used with wire shelf segments of standard shelfing, where recesses or cups are present in the aft portion, only one or at most two cups or recesses for accepting a support wire of a wire shelf are present, one at its free end and the other, if present, along the length thereof. Here the placement of the cups or recesses and the length of the aft portion of the shelf bracket are selected to allow the fore section of the shelf extension bracket to accept wire shelf segments having a depth of either a 6 inches or 12 inches. The design could also be set to allow for acceptance of a wire shelf segment having a depth of 16 inches; however, it is believed that wire shelf segments of greater than 12 inches in depth may lead to instability, particularly if the weight of the items to be placed on the shelf is significant. Added stability may be provided by shaping the aft end of the bracket to allow for two or more shelf supports wires to be engaged simultaneously by the aft section of the bracket, i.e., the aft end of the bracket in use lies below two or more support wires provided that the front edge wire support lies below the bracket. Alternatively, the system may employ other supports that connect the wire shelf segments to a wall or other mounting surface.

In the fifth embodiment, the aft section of the shelf extension bracket will be substantially of the same shape, design, length and elements as any of the extended segments of the third embodiment discussed above.

In contrast to the marked difference in the aft portions of the extension brackets of the fourth and fifth embodiments, the shape, design, length, and elements of the fore section of the brackets of the fourth and fifth embodiments are the same. As noted, the fore section of the bracket serves as a seat for a wire shelf segment. According to a first option, the fore section has the shape of the cross-section of a tray wherein the tray has a length that coincides with the width of the wire shelf segment to be inserted therein and the depth of the tray is such that when the wire shelf segment is placed therein the stringer wires of the wire shelf segment are coplanar or essentially coplanar with the uppermost surface of the extension bracket. Most preferably, when the wire shelf segment is placed in the tray, its surface is coplanar with the existing wire shelf to which it is attached. In these embodiments, the length of the tray may be sized to accept the largest wire shelf segment contemplated for the extension bracket making it suitable for all sizes. Alternatively, multiple extension brackets may be produced, each having a tray length that coincides with the width of the wire shelf segment to be used. Here, the wire shelf segment is held in place by the walls of the tray or may be held in place by recesses and/or stops along the upper surface of the extension bracket in the tray: most notably, the length corresponds to the distance between the front and back edge support wires of the wire shelf segment to be placed therein and, as noted above, the height of the walls of the tray (the depth of the tray) is such that when a wire shelf segment is placed in the tray, the surface thereof is substantially coplanar with the shelf to which it is attached.

Alternatively, the fore section may have a plurality of "U" shape cups or recesses in the upper surface of the extension bracket, one at or near the free end of the extension bracket for accepting the front support wire of the wire shelf segment and the others placed along the upper surface of the fore section of the extension bracket so that they correspond to the back edge support wire and/or intermediate support wires of the wire shelf segments to be seated. The extent of the depth of the "U" shaped cups or recesses, as in all embodiments, are the same and are preferably set to accept the support wires while maintaining a coplanar of substantially coplanar surface between the existing shelf and the wire shelf segment. This particular extension bracket design has the added benefit of being able to accept wire shelf segments of different depths/widths. When using narrow width wire shelf segments they may be placed in the recesses so that a gap exists in the overall shelf surface or such that no gap exists in the overall shelf surface and the fore section of the extension brackets present arms from which additional items may be hung. Alternatively, to maintain a continuous shelf top, when inserting the extended segments through the stringer wires of the existing shelf one or more of the cups or recesses may also be passed through the plane of the shelf so that when the extension bracket is lowered and rests on the upper surface of the first support wire of the existing shelf, that first support wire lies between two cups or recesses in the fore section of the extension bracket. Indeed, depending upon its positioning and the design of the shelf to which it is attached, the positioning of the recess aft of the first support wire may coincide with an intermediate support wire of the shelf in which case it now serves and acts as a part of the aft section of the extension bracket.

In use, the brackets of the fourth and fifth embodiments are employed in pairs or, more preferably, multiples, spaced along the existing shelf. Each is inserted as in the case of the first and third embodiments, respectively, except that once the brackets are in place, the wire shelf segment is then added to the fore section of the brackets.

Additional variations and alterations are possible. For instance, in each of the foregoing embodiments, some or all of the "U" shapes cups or recesses may be sized to provide a slight interference fit with the support wires they engage. Additionally, where the stringer wire extended segments and/or extension brackets have a diameter that is greater than the stringer wires of the shelf, those stringer wire extended segments and shelf extension brackets may have one or more recesses formed into their lower surface at the point(s) where they will ride over the front edge support wire and any other intermediate support wires The presence of these recesses allows the shelf extension or bracket, as appropriate, to sit lower on the support wires of the existing shelf. However, the depth of these recesses should be less than half, preferably no more than one-third, the diameter or width of the stringer wire extended segment or extension bracket to avoid disrupting or compromising the integrity of the stringer wire extended segment or extension bracket, as appropriate.

DETAILED DESCRIPTION

Figure 1:
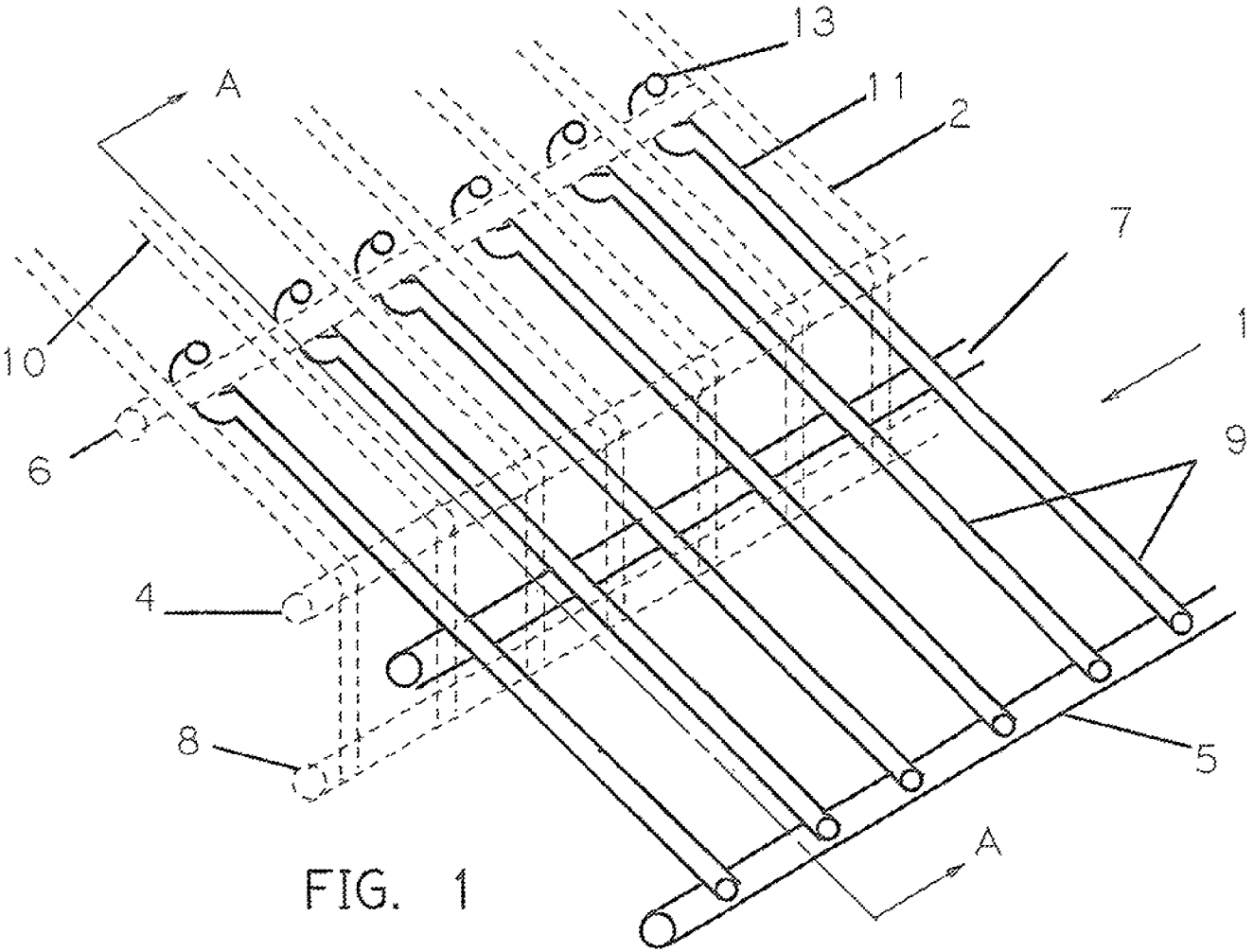
FIG. 1 is an elevated partial view of a shelf extension according to the first embodiment.

Though defined in the background, for clarity and simplicity sake the following are the definitions of the primary components of the structural elements of the present teaching.

"Support wires" are those wires that run the length of the shelf. "Stringer wires" are those wires that run across the width of the shelf, overlaying and bonded, typically welded, to the support wires: the upper surface of which defines the surface of the shelf. Stringer wires may be the same diameter as the support wires, but are more typically of diameters that are 20% to 75%, especially 25% to 50%, the diameter of the support wires.

The term "front" or "fore" when speaking of a shelf, shelf extension or extension bracket refers to the edge, portion or element furthest from the wall or other support to which the shelf is mounted or, in the case of the shelf extension or bracket, from the shelf to which it is/is to be attached.

The term "back" or "aft" when speaking of a shelf, shelf extension or support refers to the edge, portion or element closest to the wall or other support to which the shelf is mounted or, in the case of the shelf extension or bracket, to the shelf to which it is/is to be attached.

"Spaced support wire" refers to a support wire that is spaced a distance from the front support wire wherein the plane containing both the front support wire and the space support wire is generally perpendicular to the plane containing both the front and back support wires.

As used herein the terms "depth" and "width" in reference to a shelf or shelf extension are used interchangeably and refer to the distance from the front of a shelf to the back of the shelf. The "length" of a shelf is the distance a shelf extends along the wall or other mounting surface.

The term "self-supporting" when used in relation to a shelf extension means that the shelf extension is able to be supported by the existing shelf to which it is attached: though a user may opt to add additional support to connect the shelf extension to a wall or other mounting surface using conventional support/connector elements. The latter may be especially desirable and preferred where a shelf extension is to have a heavy load and/or the shelf extension if greater than 12 inches wide. Generally speaking, all of the embodiments are capable of being self-supporting if extended segments and/or brackets proper diameter or thickness and/or strength are employed in sufficient number all of which is a matter of common sense and/or is easily found through simple testing.

"Wire" refers to a rod or rod-like element, most preferably having a circular cross-section, which may be made of a composite, plastic or metal, preferably metal, with or without a plastic coating, whose diameters are consistent with those used in the wire shelf industry. Generally such wires will self-support, i.e., will stand on end without collapsing over. If a plastic or rubber-like coating is present, it is typically applied after assembly of the units, i.e., the shelf extension, extension bracket, wire shelf segments, etc., would be coated as a whole, as is conventional in the art.

An "upwardly facing" cup or recess is one that is formed in the surface of the stringer wire that is opposite that which is bonded to the support wire.

For purposes of further clarification and understanding, as used herein the terms "may", "can be", and "is" are used interchangeably. Specifically, the term "may" is intended to mean that the feature is or can be present or is an option that is contemplated and enabled, not that it is merely a possibility of unknown result. In this regard, e.g., unless contrary to the context of the discussion, the term "may have" means that it "will have", "can have", or "is", though other options exist.

Similarly, the term "coplanar" as used herein, especially with respect to the shelf extension and the pre-existing shelf, is to be understood as contemplating both actual coplanar relationship as well as planes that are parallel to but slightly removed from one another, preferably no more than $1/8^{th}$ inch, more preferably no more than $1/16^{th}$ inch, and/or planes that are at a slight angle relative to one another, preferably no more than a 10° angle, more preferably no more than a 5° angle.

Finally, while the cups and recesses are most often characterized herein as being "U" or "V" shaped, it is to be understood that such term includes any shape recess or indentation which cradles or acts as a seat for the support wire. For example, the cup or shape may be of a partial "U" or "V", especially where one side is shorter than the other or missing altogether, or have a shape similar to the tail of a "J". The characterization as "U" and/or "V" shape is merely for ease of visualization of the cup or recess while reading the specification.

The present teachings provide for simple one- and two-piece wire shelf extensions as well as wire shelf extension brackets by which standard commercial, stock shelving may be added to existing shelving to extend the shelf depth without the need for additional support, e.g., braces, wall mounts, etc.

According to the first embodiment of the present teaching, the shelf extensions are self-supporting, single-unit shelf elements comprising a plurality of support and stringer wires, again with the stringer wires overlaying the support wires and forming the support surface of the shelf extension, wherein the stringer wires extend from one support wire, the front edge extension support wire, to a second extension support wire, the back extension support wire, with or without additional intermediate extension support wires, provided that at least two of the extension stringer wires have extended segments that a) extend past the second extension support wire a distance that is the same as the width of the shelf to which it is to be attached or, if the shelf contains one or more intermediate support wires, a distance that is at least as great as the distance from the front support wire to the nearest intermediate support wire and b) optionally, though preferably, have at least one "U" or "V" shaped cup or recess at the end thereof and/or along the length thereof that are intended to accept a support wire of the wire shelving to which it is to be attached.

The shelf extensions of the present teaching are of varying widths, but are most typically from about 2 to about 16 inches, preferably from about 6 to about 12 inches, excluding the extended segment. In general this represents the width of the shelf portion of the shelf extension and it generally measured from the front edge extension support to the back extension support. Shelf extensions of greater than 16 inches in width are possible, though not advised since that will create instability and, most likely, require additional support such mounting, directly or indirectly to a wall or other mounting or support surface or element. Shelf extension of 12 inches or more in width will preferably have at least one intermediate shelf extension support wire, most typically at the midpoint of the width of the shelf.

The extension stringer wires will extend from the front extension support to the back extension support provided, as noted previously, that at least two of the extension stringer wires have an extended segment that extends past the second extension support wire a distance that is the same as width of the shelf to which it is to be attached or, if the shelf contains one or more intermediate support wires, a distance that is at least as great as the distance from the front support wire to the nearest intermediate support wire. Typically, the extended segments have a length of at least 1 to 2 inches up to 12 inches, preferably a length of 2 to 10 inches, more preferably 4 to 8 inches. Generally speaking, all of the extension stringer wires are of the same diameter or thickness, typically the same as or similar to that of the shelf to which the shelf extension is to be attached, and have the extended segments. However, such is not necessary depending upon the load to be borne by the shelf extension and/or the diameter or thickness of the stringer wires having the extended segment, most especially their strength and resistance to bending under load. For example, from a cost perspective and ease of use perspective, it may be more desirable to stagger the extension stringer wires having the extended segment whereby the extended segment is present on every other, every third, every fourth, etc. extension stringer wire. Most preferably, especially where the extension stringer wires are in a loose arrangement, e.g., spaced every inch or so, an extended segment will be present on every fourth or sixth stringer wire. This generally corresponds to a shelf extension where an extended segment is located every four or six inches along the length of the shelf extension: though 12 inch spacing is also possible. Most preferably, especially when the spacing between extended segments is large, especially on shelving intended to carry a heavy load, and/or when fewer than all of the extension stringer wires have the extended segment, the extension stringer wires with the extended segment will have a diameter or thickness that is greater than the other extension stringer wires: typically 1× to 3× or more the thickness or diameter of the extension stringer wires without the extended segments.

Optionally, though preferably, the extended segments of the extension stringer wires will have one or more upwardly facing "U" or "V" shaped cups or recesses at the end thereof and/or along the length thereof that are intended to accept a support wire of the wire shelving to which it is to be attached. The presence of the U" or "V" shaped cups or recesses, particularly at the ends of the extended segments prevents the shelf extension from unintentionally or unexpectedly disengaging from the support against which it is cantilevered as may happen if the extended segment ends at or just past the support wire to which it is biased and the shelf is accidently pulled or moved. Where the cup or recess is at the end of the extension stringer wire extended segment, the height of the aft wall of the cup or recess is preferably at least one quarter the thickness of the support wire to which it is to be attached, more preferably at least one half the thickness of the support wire to which it is to be attached, most preferably the same thickness as the support wire to which is it to be attached. In this regard, the cup or recess may have more of a "J" shape, with or without the upturned end, though most preferably with an upturned end so that there is a minimal lip portion to the aft wall of the cup or recess. Specifically, because the shelf extension is held in place through a cantilever set up, the combined action of the upward force of the extended segment against the support wire and the lip on the end of the extended segment serve to lock the shelf extension in place, particularly where a full or mostly full "U" shaped cup or recess is present. Finally, while the aft wall of the cup or recess could be greater in height than the thickness or diameter of the support wire, most preferably is it no more than the combined width of the support wire and the stringer wire of the shelf to which the extension is to be attached. If greater, then one risks the ends of the extended segments catching on the items to be placed on the shelf.

The width and depth of the "U" or "V" shaped cups or recesses along the length of the extended segment, and as noted in the previous paragraph, at the end of the extended segment, are sized to serve as a seat for the support wires wherein at least one-quarter, preferably at least one-third, more preferably at least about one-half the diameter or thickness of the support wire is able to be situated in the cup or recess. Most preferably, the depth of the recess is the same as the thickness or diameter of the support wire to be situated therein unless the extension has another bend or angle to it, so that the shelf extension will lie flat in a coplanar relationship with the shelf to which it is to be attached. Similarly, the width of the cup or recess is at least sufficient to allow the support to sit in the bottom of the cup or recess. Such fit may be a loose fit or there may be a slight interference fit so that the two cannot become disengaged without some deliberate effort.

As noted, a cup or recess may be at the end of the extended segment or one or more cups or recesses may be along the upward surface of the extended segment or both. By adding a plurality of cups or recesses, especially if there is only one support wire to which it can connect, one is able to add adjustability to the depth of the shelf extension. Where there are multiple support wires to which it can connect, a single cup or recess at the end of the extended segment will suffice since one is able to make adjustments to the shelf depth by selection of the support wire to which the extended segment is to be connected. Still, a plurality of cups or recesses and a plurality of support wires provides even greater versatility in use enabling the user to custom size the depth of the shelf extension to meet their needs.

As noted, the extent to which the shelf may be extended is dependent upon the number and location of the support wires in the wire shelving to which the extended segment can be attached and the length of the extended segment and/or the number and spacing of the cups or recesses in the stringer wire extended segments. At a minimum, the length of the stringer wire extended segments is such that when the back extension support wire lies next to the outer face of the front edge of the wire shelf, the cup or recess on the extension stringer wire extended segment is able to accept the first of the intermediate supports nearest the first or front support wire of the shelf or, if none, the back or second support wire of the shelf. The maximum length of the extension stringer wire extended segment is the width of the shelf to which it is to be attached. However, since most wire shelving, particularly that of at least a twelve inch width, has at least one intermediate support wire, most typically at or near the midpoint of the width of the shelf, a universal shelf extension will have extended segments whose length is or is a little more than one-half the width of the shelf to which it is to be attached. In this way, the cup or recess of the stringer wire extended segment will be capable of being received by the intermediate support wire nearest the mid-point of the shelf depth. Of course, much shorter stringer wire extended segments are suitable where there are intermediate support wires near the front edge support of the wire shelf. Typically, the stringer wire extended segment is at least about 2 inches, generally from 2 to 10, preferably from 4 to 8 inches in length.

The shelf extensions of this embodiment may be used to extend the depth of planar shelves as well as those having an "L" shaped cross-section as described in the Background above. And, like the shelf to which the extension is to be attached, the shelf extension may be planar or have an "L" shaped cross-section. Again, the back of the "L" corresponds to the shelf surface of the shelf extension and the foot of the "L" to a front face of the shelf extension. Here, the foot of the "L" may either extend upward from the plane of the shelf extension, acting as a shelf lip to prevent items from falling off the shelf, or downward to provide additional structural rigidity and/or an element to hang items off of the front edge of the extended shelf. Generally speaking, the height of the front edge of the extended shelf will be from one to three inches and its construction or make-up is the same as that discussed in the Background section for the shelf itself.

According to this first embodiment, the shelf extension is attached by inserting the stringer wire extended segments at an angle, generally less than 45°, relative to the plane of the existing shelf over the first or front edge support wire and between the stringer wires of the existing shelf until the extended segment, most preferably if present, the cup or recess or one of the cups or recesses on the extended segment, engages and accepts the support wire to which it is to be connected and, if there are multiple options, that support that coincides with the added depth of shelf desired. Thereafter, the front edge of the shelf extension is lowered so that the plane of the shelf extension is coplanar with the existing shelf. At this point, the back extension support wire will be forward of the front edge support wire of the shelf. Assuming the length of the extended segments and/or the presence of intermediate support wires allow, one can readily adjust the extent to which the width of the shelf is increased by simply pulling or pushing the shelf extension along the plane of the shelf surface or, if the cups or recesses are present, by simply tipping the body of the shelf extension upward to disengage the support wire from the cup or recess of the extended segment and advancing or retracting the shelf extension until the cup or recess corresponds in location to another support wire or, if multiple cups or recesses, one of the cups or recesses corresponds in location to the same support wire or another support wire that provides for the newly desired shelf depth at which point the shelf extension is returned to its planar orientation. Notwithstanding the foregoing, if the extended segment is to be connected to a different support wire, it may be necessary to either remove the shelf extension altogether and reinsert it at the proper location. Alternatively, especially if one does not want to remove the items from the shelf, after disengaging the recess from the support wire, one may simply retract the shelf extension sufficient to have the end of the extended segment clear the support wire to which it was connected, tilt the body of the shelf extension to have the recess rise above the plane of the shelf and then either insert or retract the shelf extension so the end of the extended segment is forward of the support wire to which it is to be connected and then, tilting the body of the shelf extension upward so the recesses fall below the plane of the shelf while inserting the shelf extension until the recess aligns with the new support wire to which it is to be connected tilting the body of the shelf extension downward to allow the cup to capture the new support wire.

According to a second embodiment of the present teaching there is provided a two-piece shelf extension comprising a shelf extension element as provided in the first embodiment in combination with a separate rod or wire element, which may be of the same length and diameter as the extension support elements provided, however, that the "U" or "V" shaped cups or recesses must be present in the stringer wire extended segments. Generally speaking, the separate rod is made of metal, a molded plastic or a composite material and will have a thickness or diameter that is preferably no more than the combined width of the support wire and the stringer wire of the shelf to which the extension is to be attached. Furthermore, while it is preferable that the cup or recess have full sidewalls on both sides, i.e., a full "U" or "V" shape, such is not necessary as long as a least some piece of the aft wall is present to prevent the rod from slipping out. Preferably the height of the aft wall of the cup or recess is at least one quarter the thickness of the separate rod, more preferably at least one half the thickness of the separate rod, most preferably the same thickness as the separate rod. Additionally, the depth of the recess is such that when the shelf extension with the rod is in place, the shelf extension lies coplanar with the shelf to which it is attached. Without the lip, the separate rod could merely slip out of the cup or recess. Finally, the diameter or thickness of the separate rod is such that it is capable of being accepted by the cup(s) and/or recess(es) in the extension stringer wire extended segments and is of a length to capture a sufficient number of stringer wire extended segments to provide for a stable shelf extension.

Most preferably, in this embodiment the extension stringer wires have a single cup or recess at or near their end point of the extended segments. The extended segments themselves are of a length that is at least 1 to 2 inches but no greater that the width of the existing shelf to which it is to be attached. Preferably, the length of the extended segments is about one-half the width of the existing shelf, generally at least 1 to 2 inches up to 12 inches, preferably a length of from 2 to 10, more preferably from 4 to 8, inches. As in the first embodiment, the extended segments need not be present as part of each extension stringer wire so long as a sufficient number of extension stringer wires and/or extension stringer wires of sufficient thickness or diameter and/or strength have extended segment to secure and stabilize the shelf extension, all as discussed above.

According to this second embodiment, the shelf extension is applied in the same manner as that of the first embodiment except that after the extended segments are passed below the plane of the shelf, the separate rod is inserted into the cup or recesses of the extended segments. As one then lowers the body of the shelf extension, as described above, the separate rod engages the under surface of the shelf to secure the shelf extension. The shelf depth may simply be adjusted to the desired total depth by further inserting or retracting the shelf extension along the plane of the shelf. At most a slight tipping may be necessary if, in making the adjustment, movement of the separate is impeded by a support wire of the shelf in which case one merely tips the body of the shelf extension upward so that the separate rod is able to pass the impeding support wire.

According to a third embodiment of the present teaching there is provided a one-piece extension to be used with an "L" cross-sectioned wire shelf. Though this allows for the construction of a stepped shelf where the shelf extension sits higher than the shelf surface of the existing shelf (i.e., where the foot of the "L" extends above the plane of the shelf rather than below it), most preferably, the shelf extension of this third embodiment is used with "L" cross-sectioned wire shelving where the foot of the "L" extends downward towards the floor such that there is no front edge portion of the shelf extending above the plane of the shelf defined by stringer wires. In this embodiment the shelf extension is similar in construction and design to that of the first embodiment except that in this instance the stringer wire extended segments extend past the second extension support wire and then bend at a right angle, or nearly a right angle, below and away from the support surface of the shelf extension and continue to extend a distance that is the same as or slightly greater than the distance between the front edge support wire and the spaced support wire of the front face of the shelf to which the shelf extension is to be attached: typically 1 to 3 inches. The bend in the stringer wire extended segment is at least as far removed from the second extension support wire as will allow the front edge support wire of the existing shelf to sit in the vertex of the right angle defined by the bent extension stringer wire between the bent stringer wire extended segment at the point of the bend and the second or back extension support wire. Preferably the bend is at a point that is at least one-half inch, more preferably about 1 to 2 inches, from the second extension support wire.

Although the discussion above refers to a single right angle, or nearly so, the transition in the extended segment from that portion which is coplanar with the surface of the shelf extension to that portion which is or is essentially perpendicular to the surface of the shelf extension may have a more complicated shape, e.g., an elongated "S" like shape where the first bend is 180° or nearly so before the bend is reversed about 90° to allow the extended segment to connect with the spaced support wire while maintaining a surface of the shelf extension that is essentially coplanar with the surface of the existing shelf. With this structure, in use, the front support wire of the existing shelf will sit in the curve of the top portion of the "S".

Optionally, though preferably, the free end of the stringer wire extended segment is bent to provide a "J" shape to the bent portion such that the foot of the "J" is positioned so that it will allow the spaced support wire of the foot of the existing shelf to sit in curve of the "J". The extent or length of the foot of the "J" may vary from one that defines an eighth of a circle to one that is a full semi-circle, preferably one that defines a quarter of a circle to a full semi-circle. Alternatively, the foot of the "J" may resemble a "U" on its side or a backwards "C", with the opening facing away from the shelf extension, wherein the spaced support wire sits in the trough of the "U" in use.

As noted, the bend in the extended segment is at a right angle or near right angle to the plane of the body of the shelf extension. In order to ensure that the shelf extension lies in the same plane as the shelf to which it is/is to be attached it is preferred that the overall angle of the bent portion of the extended segment be a few degrees less than 90° so as to account for the fact that the extended segment extends from the backside of the front support wire to the front side of the spaced support wire. Alternatively, or in addition, the foot of the "J" may be a formed as a cup or recess, similar to or the same as the "U" shaped cup or recess of the first embodiment or it may itself be first bent back and then forward to make a backwards "C" shape whereby the spaced support sits in the cup or recess and the extended segment is perpendicular to the surface of the shelf extension.

As another option, especially to allow for universal use with the products of multiple manufacturers and/or the addition of a hanger rod, the length of the bent portion of the stringer wire extended segment is elongated to match or be longer than the largest spacing between the front edge support and the spaced support of commercial products, respectively, with our without, though preferably with, one or more "U" or "V" shaped cups or recesses in the upper surface (i.e., the aft facing vertical surface in use) thereof. Such bent portions may be from 2 to 6, preferably, 3 to 4, inches in length, i.e., from the bend to the end of the extended segment. Where recesses are present, their placement will preferably coincide with the spacing of the spaced support wires of the various commercial products. In this embodiment, the ends of the extended segments may be in a "J" shape and the shelf extension may be used with a separate rod, as in the second embodiment, except here the rod acts as a hanger or bar. Here the "J" has a sufficiently high outer lip so that the separate rod does not inadvertently fall out of the extended segment. Alternatively, once installed the free ends of the bent portion, i.e., the vertical portion, of the extended segments may be cut to size and the ends capped or otherwise modified to shield the sharp edges formed when cutting the wires.

As with the first embodiment, it is not necessary that all stringer wires of the shelf extension have the extended segment. Rather, as discussed above, it is only necessary that a sufficient number of the extension stringer wires have the extended segment as will provide sufficient strength to hold up the shelf extension with the added weight of whatever is to be placed on the shelf. Alternatively or in addition, again as with the first embodiment, some or all of those stringer wires of the shelf extension that have the extended segment may be of a larger diameter wire than the other stringer wires so as to ensure adequate support and strength.

The shelf extension of this embodiment is applied by inserting the extension stringer wire extended segments downward through the plane of the shelf and between the stringer wires of the existing shelf behind the front edge support wire, but before any intermediate support wires, if any, and lowering the extension at an angle so that the stringer wire extended segments fall in front of the spaced support wire. The body of the shelf extension is then lowered so that the surface of the shelf extension is coplanar with the shelf and the front edge support wire of the shelf sits in the right angle bend of the stringer wire extended segment and the free end of the stringer wire extended segment rests against the outer surface of the space support wire. Alternatively, where the end of the extended segments have a "U" or backwards "C" shaped cup or recess, the extension stringer wires are inserted until the "U" or backwards "C" shaped cup or recess accepts the spaced support and then the front edge of the shelf extension is lowered while being brought forward until the shelf extension rests on the front support wire of the existing shelf.

According to a fourth and a fifth embodiment of the present teaching there are provided shelf extension brackets having an aft section and a fore section wherein the aft section mimics the design and ultimately the purpose of the stringer wire extended segments of the first and third embodiments, respectively, and the fore section defines a seat for a wire shelf segment: the seat, in use, extending across the width of the shelf segment. The brackets of the fourth and fifth embodiments may be made of a composite material, a molded plastic or a formed metal strip or rod/wire. Preferably, the brackets are formed of a metal rod whose width or diameter is from one that is the same as or a similar diameter to that of the support wires of the wire shelf to two to three times or more the diameter of the support wires.

In the fourth embodiment, the aft section of the shelf extension bracket may have the shape, length, design and elements of any of the stringer wire extended segments of the first embodiment. Typically, because the extension brackets are used with wire shelf segments of standard shelfing, where recesses or cups are present in the aft portion, only one or at most two cups or recesses for accepting a support wire of a wire shelf are present, one at its free end and the other, if present, along the length thereof. Here the placement of the cups or recesses and the length of the aft portion of the shelf bracket are preferably selected to allow the fore section of the shelf extension bracket to accept wire shelf segments having a depth of either 6 inches or 12 inches. The design could also be set to allow for acceptance of a wire shelf segment having a depth of 16 inches; however, it is believed that wire shelf segments of greater than 12 inches in depth may lead to instability, particularly if the weight of the items to be placed on the shelf is significant. Added stability may be provided by shaping the aft end of the bracket to allow for two or more shelf supports wires to be engaged simultaneously by the aft section of the bracket, i.e., the aft end of the bracket in use lies below two or more support wires provided that the front edge wire support lies below the bracket. Alternatively, the system may employ other supports that connect the wire shelf segments to a wall or other mounting surface.

In the fifth embodiment, the aft section of the shelf extension bracket will be substantially of the same shape, design, length and construction as any of the extended segments of the extension stringer wires of the third embodiment. This embodiment, like the third embodiment discussed above, is directed for use with those existing shelves having an "L" shaped cross-section.

In contrast to the aft sections of the brackets of the fourth and fifth embodiments which, as noted above, are markedly different, the fore sections of the brackets of the fourth and fifth embodiments are the same. The fore section of the bracket serves as a seat or tray for a wire shelf segment. According to a first option, the fore section of the extension bracket has the shape of the cross-section of a tray wherein the tray has a length that coincides with the width of the wire segment to be inserted therein and the depth of the tray is such that when the wire shelf segment is placed therein the stringer wires of the wire shelf segment are coplanar or essentially coplanar with the uppermost surface of the extension bracket. Most preferably, when the wire shelf segment is placed in the tray, its surface is coplanar with the existing wire shelf to which it is attached. In these embodiments, the length of the tray may be sized to accept the largest wire shelf segment contemplated for the extension bracket making it suitable for all sizes. Alternatively, extension brackets of multiple tray lengths may be produced wherein the lengths coincide with the commercially available widths of wire shelving. Here, where the width of the tray coincides with the width of the wire shelf segment, the latter is held in place by the walls of the tray. Alternatively, or in addition thereto, especially if the tray is an extended tray to allow for wire shelf segments of varying widths, the tray surface may have multiple recesses and/or stops along the upper surface which coincide with the spacing of the support wires of the wire shelf segments to seat/hold the wire shelf segment in place in the tray.

In an alternative embodiment, a plurality of "U" shape cups or recesses may be present in the upper surface of the fore section, one at or near the free end of the fore section of the extension bracket for accepting the front support wire of the wire shelf segment and the others placed along the upper surface of the fore section of the extension bracket so that they correspond to the back edge support wire and/or any intermediate support wires of the wire shelf segments to be seated therein. The extent of the depth of the "U" shaped cups or recesses, as in all embodiments, are the same and are preferably set to accept the support wires while maintaining a coplanar of substantially coplanar surface between the existing shelf and the wire shelf segment.

When the fore end of the extension bracket has a plurality of recesses in addition to the one at the free end of the fore section, the shelf may be used with wire shelf segments of different widths. When using narrow width wire shelf segments they may be placed in the recesses so that a gap exists in the overall shelf surface or such that no gap exists in the overall shelf surface and the fore section of the extension brackets present arms from which additional items may be hung. Alternatively, and preferably, to maintain a continuous shelf top, the placement of the extension bracket on the existing shelf may be adjusted to accommodate the different wire shelf segment widths: inserted deeper into the existing shelf for narrower wire shelf segments and retracted from the existing shelf for wider wire shelf segments. Furthermore, the point at which the extension bracket is inserted through the plane of the existing shelf may also vary depending upon the width of the wire shelf segment to be employed and the positioning of the recesses on the extension bracket and the support wires of the existing shelf. Specifically, especially with wider wire shelf segments, the aft end of the extension bracket is inserted through the plane of the shelf between the first support wire and the first or fore intermediate support wire. With narrower wire shelf segments, depending upon the length of the extended segment and the relative position of the recess intended for the second or back edge support wire of the wide shelf segment, it may be necessary to insert the at end of the extension bracket between the fore intermediate support wire and the back or second intermediate support wires of the existing shelf unless the alignment is such that the recess intended for the back support wire of the wide shelf segment aligns with the fore intermediate support of the existing shelf, in which case, it now serves as a seat for the existing shelf support wire.

In use, the brackets of the fourth and fifth embodiments are employed in pairs or, more preferably, multiples, spaced along the existing shelf. As with the previous embodiments, the spacing may be every 4, 6, 8, etc. inches depending, in part, upon the strength of the extension brackets and the load to be borne by the shelf. In any event, each of the extension brackets as in the case of the first and third embodiments, respectively, or as noted immediately above, except that once the brackets are in place, the wire shelf segment is then added to the seat or tray of the fore portion of the brackets.

Additional variations and alterations of each of the foregoing embodiments are contemplated and possible as will be readily appreciated and recognized by those skilled in the art having the knowledge and teaching hereof. For instance, in each of the foregoing embodiments, some or all of the "U" shapes cups or recesses may be sized to provide a slight interference fit with the support wires they engage. Such an interference fit will prevent the unintended or accidental disengagement of the shelf extension and/or shelf extension brackets during use. Additionally, where the stringer wire extended segments and/or brackets have a diameter that is greater than the stringer wires of the shelf to which it is to be attached, those stringer wire extended segments and shelf extension brackets may have one or more recesses formed into their lower surface at the point(s) where they will ride over the front edge support wire and any other intermediate support wires to allow the same to sit lower on those support wires: thereby bringing the plane of the shelf extension more coplanar with the existing shelf, particularly in those instances where not all of the extension stringer wires have the extended segment. However, the depth of these recesses should be less than half, preferably no more than one-third, the diameter or width of the stringer wire extended segment or extension bracket to avoid disrupting or compromising the integrity of the stringer wire extended segment or extension bracket, as appropriate. This is particularly important where the shelf is to hold a heavy load. Furthermore, where the plane of the shelf extension or the wire shelf segment sits above the plane of the shelf to which it is attached, there is concern that objects being removed from the expanded shelf may catch on the aft ends of the stringer wires that do not have extended segments. Here, this concern can be allayed by simply turning down the ends of those stringer wires so they angle away from the plane of the shelf.

Having described the various embodiments of the present teachings in general terms, attention is now directed to the appended drawings where various iterations or each embodiment are presented, as described below. In the drawings, to help distinguish between the elements of the articles of the present teaching and those of the existing shelf to which it is attached, the latter is drawn in broken lines.

FIG. 1 presents an elevated, partial end view of an iteration of a wire shelf extension element 1 according to the first embodiment discussed above attached to the fore section of an existing wire shelf 2. The wire shelf extension comprises a first extension support wire 5 and a back or second extension support wire 7 and a plurality of extension stringer wires 9 each having an extended segment 11 ending in a "U" shaped cup or recess 13. The existing shelf 2 comprises a first support wire 4, an intermediate support wire 6, a back support wire (not shown) and a spaced support wire 8 and a plurality of stringer wires 10. As shown, the extended segments 11 of the extension stringer wires 9 pass over the first support wire 4 and under the intermediate support wire 6 with the latter sitting in the "U" shaped cup or recess 13 of the extended segments. The shelf extension 1 is essentially cantilevered over the first support wire 4 with the intermediate support wire 6 nested in the "U" shaped cups 13, thereby securing the shelf extension to the existing wire shelf.

Figure 2:
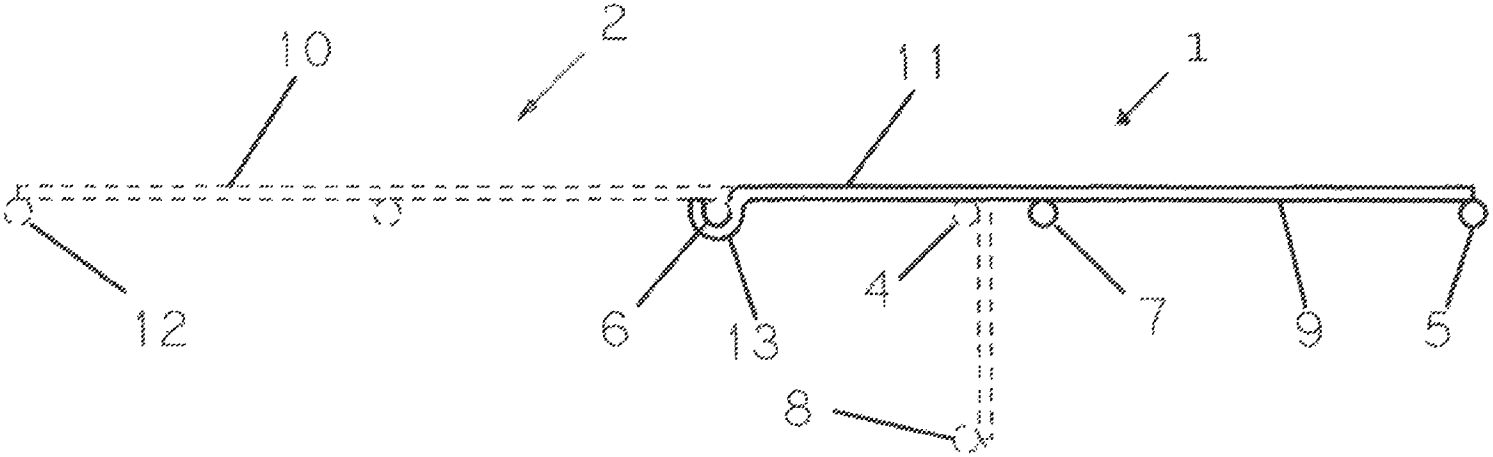
FIG. 2 is cross-sectional view of the shelf extension of FIG. 1 taken along line A-A.

FIG. 2 shows a full cross-sectional view of the existing shelf and shelf extension configuration of FIG. 1 taken along the line A-A. Again, the existing shelf 2 comprises a first support wire 4, an intermediate support wire 6, a back support wire 12, and a spaced support wire 8 and a plurality of stringer wires 10 overlaying all of the support wires. The shelf extension 1 comprises a first extension support wire 5 and a back or second extension support wire 7 and a plurality of extension stringer wires 9 each having an extended segment 11 ending in a "U" shaped cup or recess 13.

Figure 4:
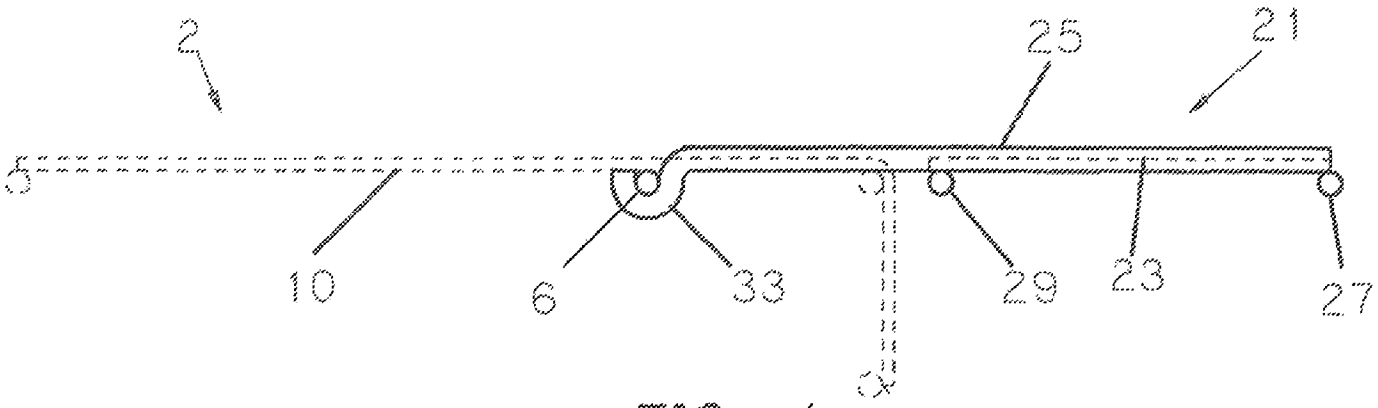
FIG. 4 is a cross-sectional view of the shelf extension of FIG. 3 taken along line B-B.
Figure 3:
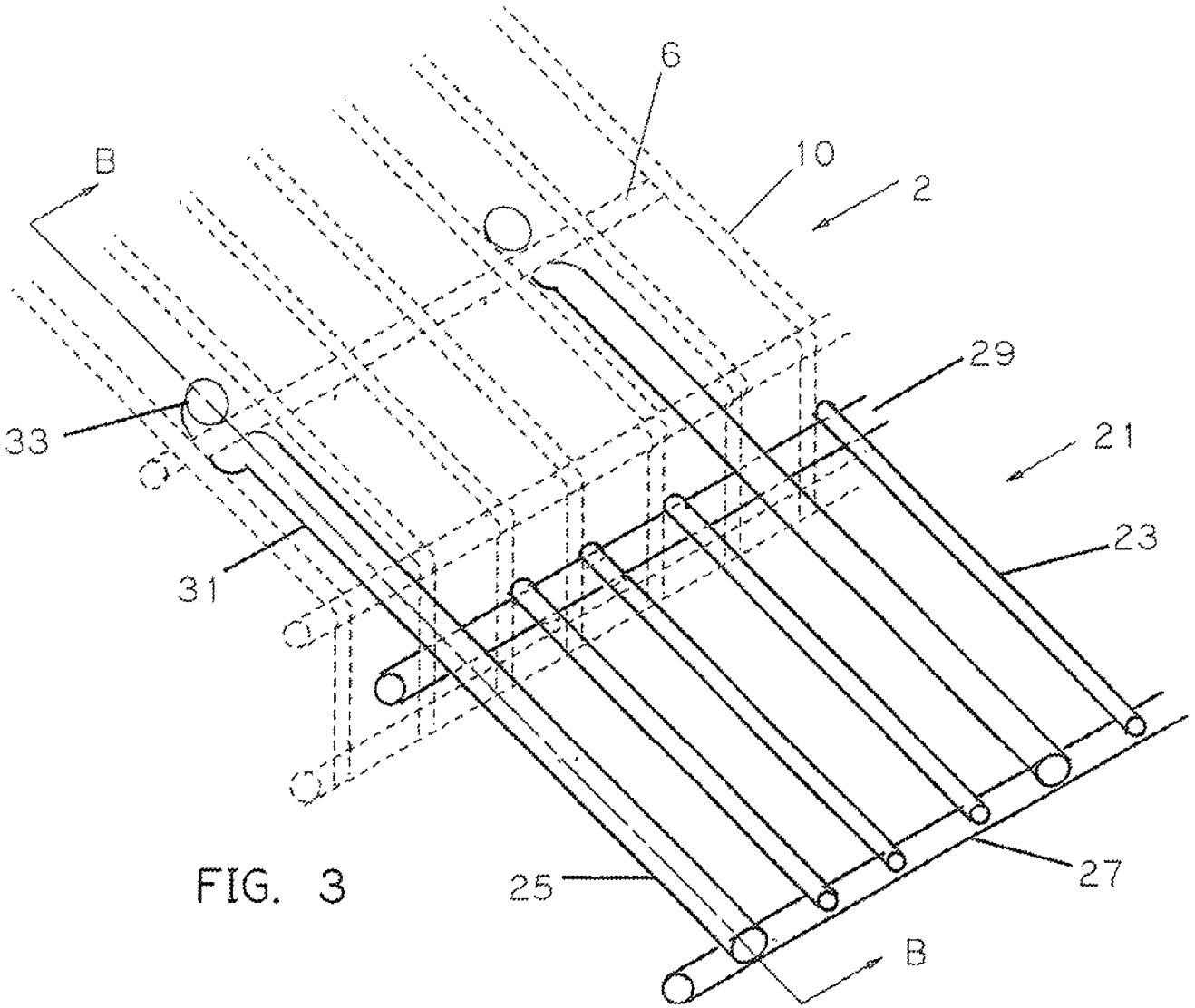
FIG. 3 is an elevated partial view of an alternate shelf extension according to the first embodiment.
Figure 6:
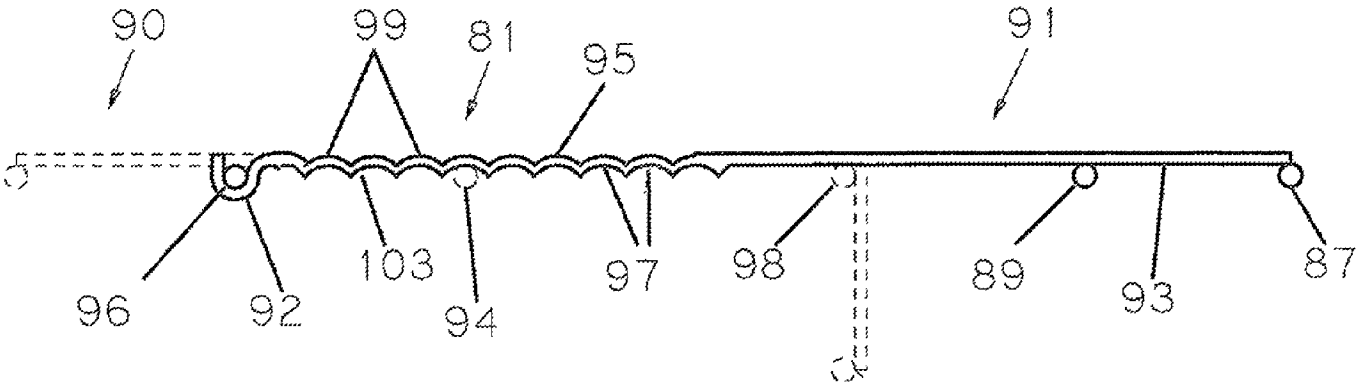
FIG. 6 is a cross-sectional view of a shelf extension according to the second embodiment.

FIG. 3 presents an elevated, partial end view of another iteration of a wire shelf extension element 21 according to the first embodiment discussed above with the exception that some of the extension stringer wires have the extended segment and others do not. Specifically, as shown, a first set of extension stringer wires 23 merely extend from first extension support 27 to the second extension support 29. The remaining extension support wires 25 each have an extended segment 31 having a "U" shaped cup or recess 33 in the free end of the extended segment. As shown, and as in the previous embodiment shown in FIG. 1 an intermediate support 6 of the existing shelf 2 sits in the recess 33. Also, as shown in FIG. 3, the extension stringer wires 25 having the extended segments are of a slightly greater diameter than the other extension stringer wires 23, as well as the stringer wires 10 of the existing shelf 2. As shown in FIG. 4, which shows cross-sectional view of the existing shelf and shelf extension configuration of FIG. 3 taken along the line B-B, this construction causes the plane of those extension stringer wires 25 to stand slightly above, but parallel to the plane of the remaining extension stringer wires. Although this construction allows for greater strength in the extension stringer wires and, hence, the greater ability to lessen the number of extension stringer wires having the extended segments, it does lead to an uneven surface: though of minimal consequence. Nevertheless, if desired, those extension stringer wires having a greater diameter or thickness can have one or more recesses or a scalloped pattern formed in their lower surface where they meet the extension support wires so that the upper surface of such extension support wires is coplanar or more coplanar with the upper surface of the remaining extension support wires. Such scalloping or recesses may also be in the fore ends of the extension stringer wires of larger diameter or thickness where they join the front and back extension support wires, again, to bring the upper surface of all extension stringer wires into a coplanar or substantially coplanar relationship. FIG. 6 provides an exemplification of the scalloping 97, though there it is shown only with respect to the extended segment of the extension stringer wire.

Figure 5B:
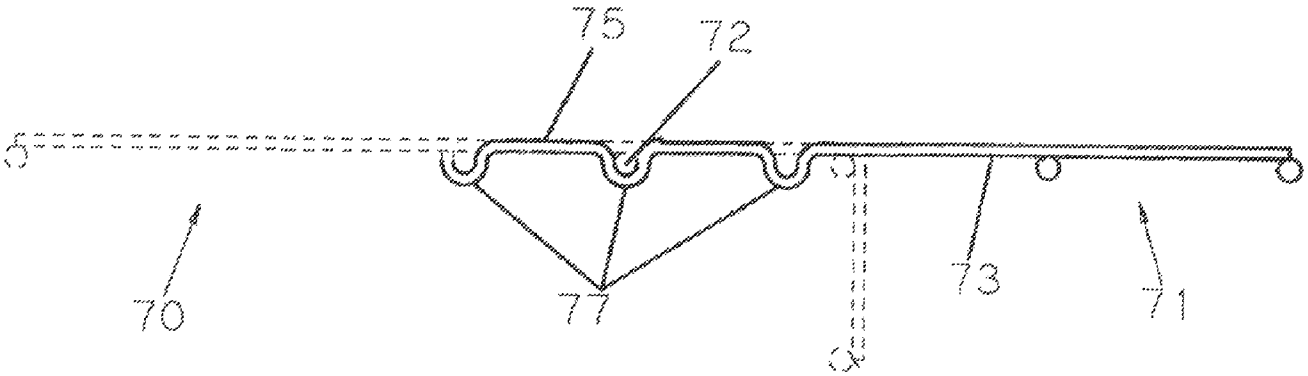
FIG. 5B is a cross-sectional view of an alternate shelf extension according to the first embodiment.
Figure 5A:
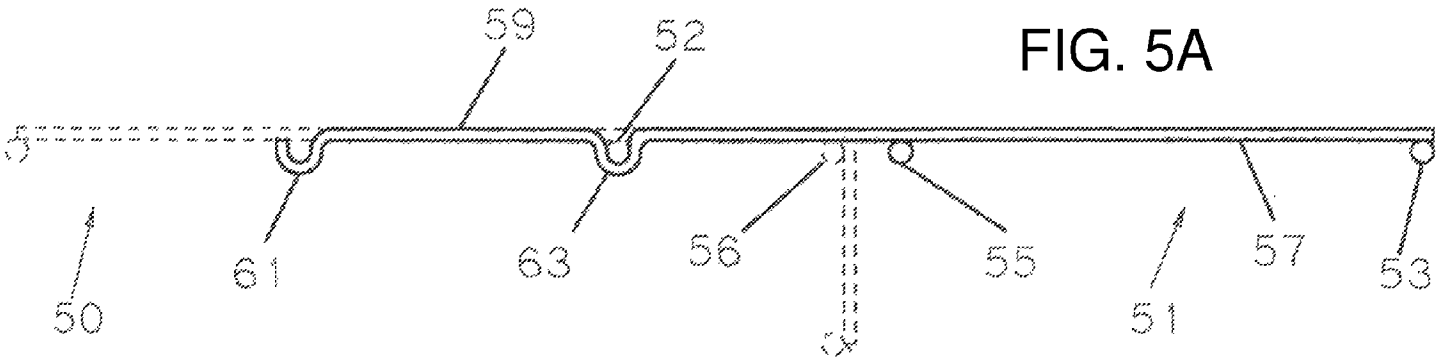
FIG. 5A is a side view of an alternate shelf extension according to the first embodiment.

FIGS. 5A and 5B show cross-sectional views of different configurations for the extension stringer wires that may be used with existing shelving have one or more intermediate support wires and which enable or facilitate adjustment in the positioning of the shelf extension, thereby allowing one to increase or decrease the extent to which an existing shelf is extended.

FIG. 5A presents a shelf extension 51 comprising a first extension support wire 53 and a second extension support wire 55 and an extension stringer wire 57 having an extended segment 59 wherein the extended segment has two recesses 61/63 for accepting the intermediate support wire 52 of an existing shelf 50. This particular shelf extension 51 may be adjusted so as to further extend the shelf than as shown. Specifically, one may simply disengage intermediate support wire 52 from the fore recess 63 of the extension stringer wire 57, pull the shelf forward until the aft recess 61 at the free end of the extended segment 59 engages and accepts the intermediate support wire 52. Should it be necessary due to the spacing of the two recesses and the spacing of the support wires of the existing shelf, the first recess 63 may be positioned forward of the first support wire 56 of the existing shelf.

FIG. 5B shows a similar configuration used with an existing wire shelf 70 having a single intermediate support wire 72 wherein the extended segment 75 of the extension stringer wire 73 of the shelf extension 71 has three recesses 77. One may simply engage the intermediate support wire 72 of the existing shelf 70 with any one of the recesses 77 depending upon the extent of the shelf extension desired. Adjustment is as simple as noted above by disengaging the intermediate support from the recess and either further inserting or retracting the shelf extension until the intermediate support aligns with one of the recesses.

FIG. 6 shows a two-piece wire shelf extension system 81 according to the third embodiment of the present teaching comprising a shelf extension 91 and a separate rod 96 positioned on an existing shelf 90. The shelf extension comprises first and second extension support wires 87/89 and extension stringer wires 93 having an extended segment 95. The extended segment ends with a "U" shaped recess 92 for accepting the separate rod 96 and the separate rod acts as the counter force to the cantilever action of the shelf extension, much like the support wires do in the previous embodiments. In this embodiment the lower surface of the extended segments has a plurality of lesser recesses 97: preferably a scalloping effect as shown. Furthermore, the upper surface of the extended segment has opposing humps 99; however, those appear if the extended segment is bent to form the recesses. Otherwise, other methods could be used to form the recesses which would not affect the smooth upper surface of the extended segments, as shown in the other figures. In any event, the use of the separate rod 96, with or without the scalloping 97, allows near universal shelf extension capability as the shelf extension is simply adjusted by pulling or pushing the shelf outward or inward, respectively. The recesses 97 are desirable as they will sit on one or more support wires 94 of the existing shelf, even the front support wire 98, so as to hold the shelf to a set depth. The multiple or scalloping recesses as shown in FIG. 6 allows for incremental increases or decreases in the shelf depth corresponding to the distances between the base 103 of one recess to the base of another recess.

Installation of the shelf extension 91 of FIG. 6 is achieved by inserting the extended segments 95 through the plane of the existing shelf 90 aft of the intermediate support wire 94 of the existing shelf. The separate rod 96 is then inserted into the "U" shaped recesses 92 of the extended segments 95 and the fore end of the shelf extension lowered until the extension stringer wires rest on the intermediate 94 and first 98 support wires of the existing shelf 90. Should one, having installed the shelf extension as shown, desire to extend the shelf to a point where the end of the extended segment is forward of the intermediate support wire 94, one would simply rise the shelf extension and remove the separate rod. Retract the extended segments through the plane of the shelf and then reinsert them through the plane of the shelf forward of the intermediate support wire, reinsert the separate rod and lower the shelf extension in place until the extension stringer wires rest on the first support wire 98.

Figure 7:
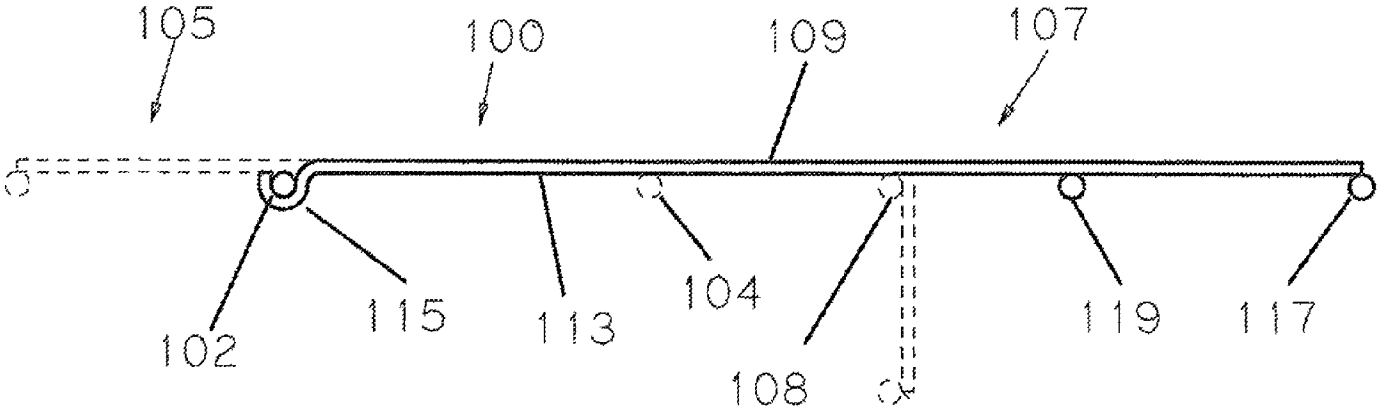
FIG. 7 is a cross-sectional view of an alternate shelf extension according to the second embodiment.

FIG. 7 shows an alternate iteration of a two-piece wire shelf extension system 100 according to the third embodiment of the present teaching comprising a shelf extension 107 and a separate rod 102 positioned on an existing shelf 105. The shelf extension 107 comprises first and second extension support wires 117/119 and extension stringer wires 109 having an elongated extended segment 113. The extended segment ends with a "U" shaped recess 115 for accepting the separate rod 102. This particular configuration allows for greater adjustment of the shelf depth without having to remove the contents on the shelf in order to move the rod past the intermediate support 104 or having to deal with the up and down motion of the scalloped extension as in the embodiment shown in FIG. 6 as one extends and retracts the shelf. While perhaps minimal in overall impact, if a shelf has a plurality of small standing items, the up and down motion may cause them to topple over; whereas this particular configuration allows for a smooth adjustment capability.

Figure 8:
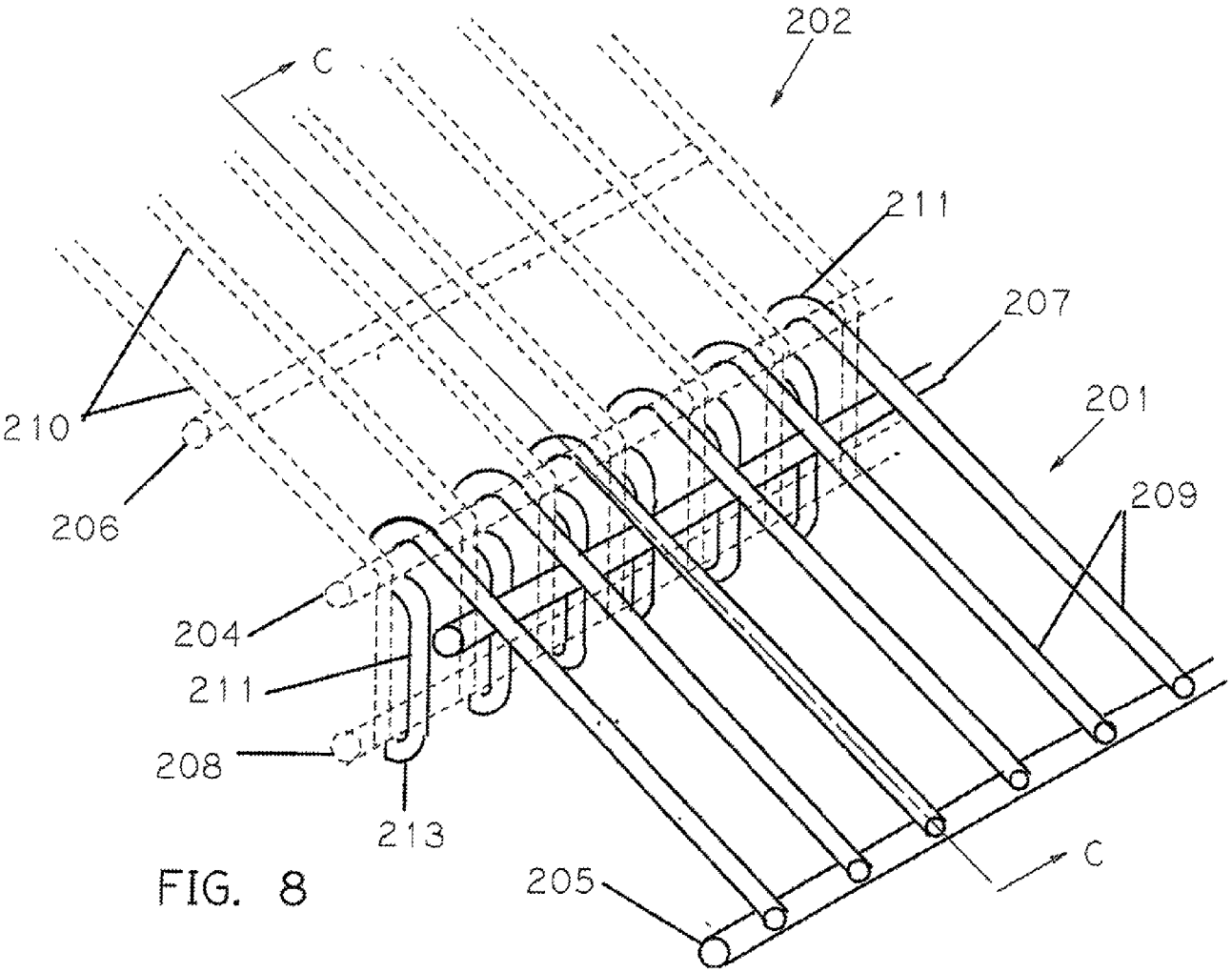
FIG. 8 is an elevated partial view of a shelf extension according to the third embodiment.

FIG. 8 presents an elevated, partial end view of an iteration of a wire shelf extension element 201 according to the second embodiment discussed above attached to the fore section of an existing wire shelf 202. The wire shelf extension comprises a first extension support wire 205 and a back or second extension support wire 207 and a plurality of extension stringer wires 209 each having an extended segment 211 ending in a "J" shaped cup or recess 213. The existing shelf 202 comprises a first support wire 204, an intermediate support wire 206, a back support wire (not shown), and a spaced support wire 208 and a plurality of stringer wires 210. As shown more clearly in FIG. 9, which presents a cross-sectional view of FIG. 8 taken along line C-C, the extended segments 211 of the extension stringer wires 209 extend to and over the first support wire 204 and then bend approximately 1800 around the first support wire to form a "C" cup 219 in which rests the first support wire 204. The extended segment then bends another 90° away from the plane of the shelf extension surface, though other near right angles are allowed, towards the spaced support wire 208. The extended segment preferably takes on the shape of a "J" where the foot of the "J" 213 acts as a seat for the spaced support wire. Although this particular drawing shows all of the extension stringer wires 209 having the extended segments 211, as in the previous embodiments, some of the extension stringer wires may end at or just past the second support wire 207 and others will have the extended segment as shown. The key, as noted above, is that a sufficient number of the extension support wires have the extended segment to provide a stable shelf.

Figure 9:
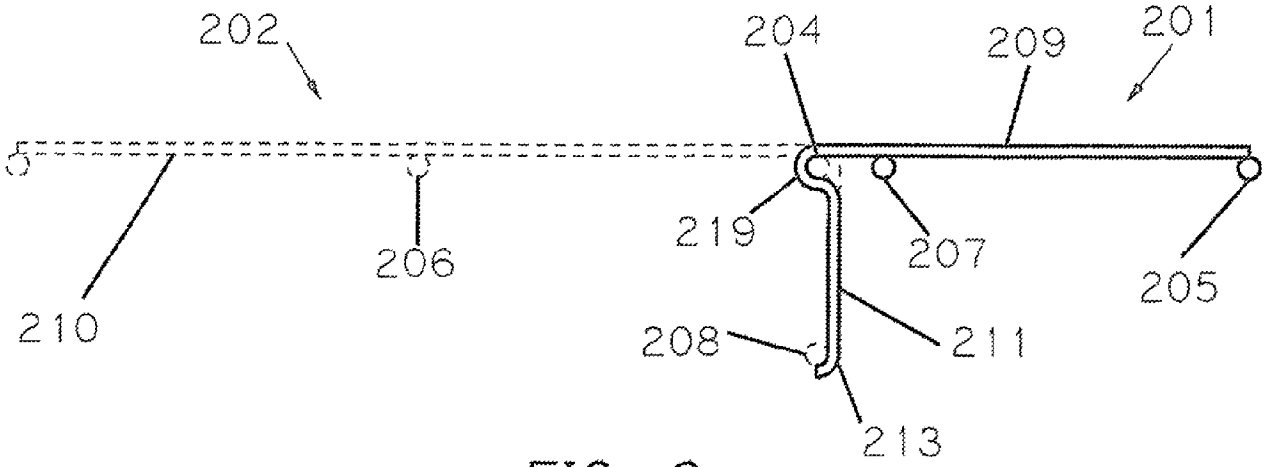
FIG. 9 is a cross-sectional view of the shelf extension of FIG. 8 taken along line C-C.
Figure 10:
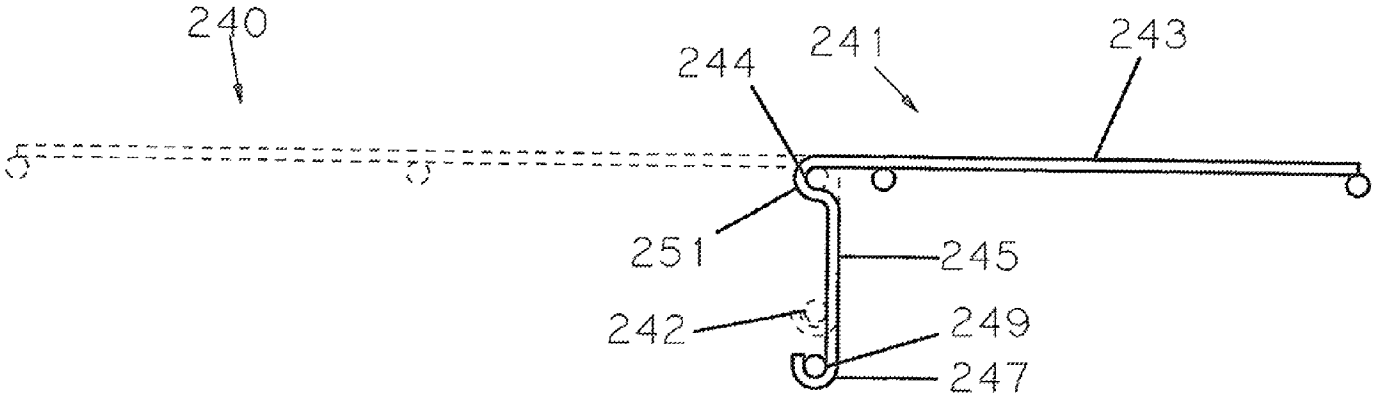
FIG. 10 is a side view of an alternate shelf extension according to the third embodiment.

FIG. 10 is a side view of an extension stringer wire 243 of a shelf extension 241 similar of design and operation to that shown in FIGS. 8 and 9 except here the extended segment 245 extends past spaced support wire 242 of the existing shelf 240 and ends in a full "J" tail 247. Here, rather than capturing the spaced support wire, the foot of the "J" holds a separate rod or wire 249 that is attached after the shelf extension 241 is put into place. The rod servers to hold the extended segments in place and may comprise an element for hanging articles therefrom, for example, clothes hangers. To hold the shelf extension in place, the first support wire 244 of the existing shelf is held in the recess 251 at the bend in the extended segment 245 and the length of the extended segment is rested against the fore surface of the spaced support wire 242.

Figure 11:
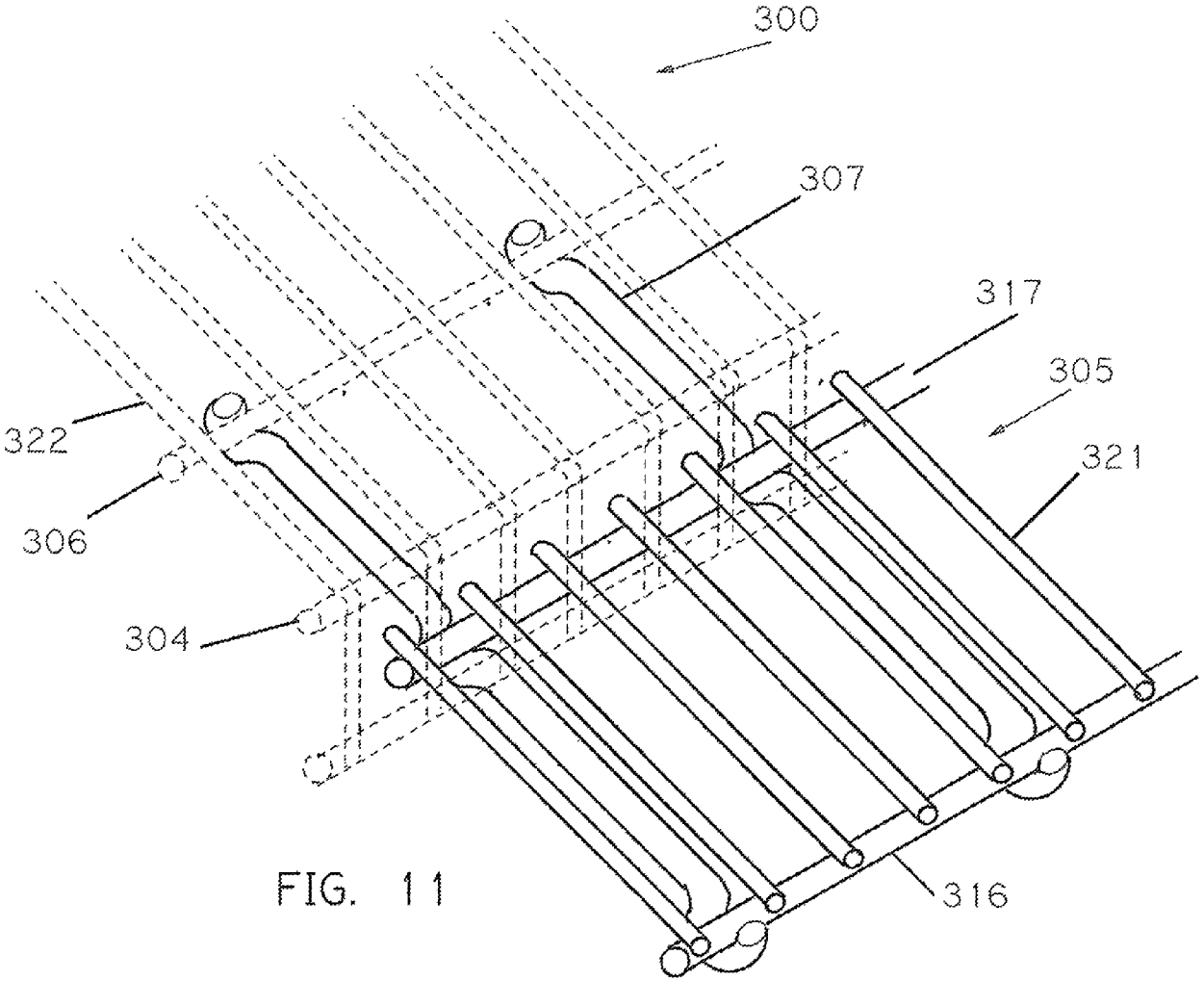
FIG. 11 is an elevated partial view of a shelf extension bracket and shelf segment according to the fourth embodiment.
Figure 12:
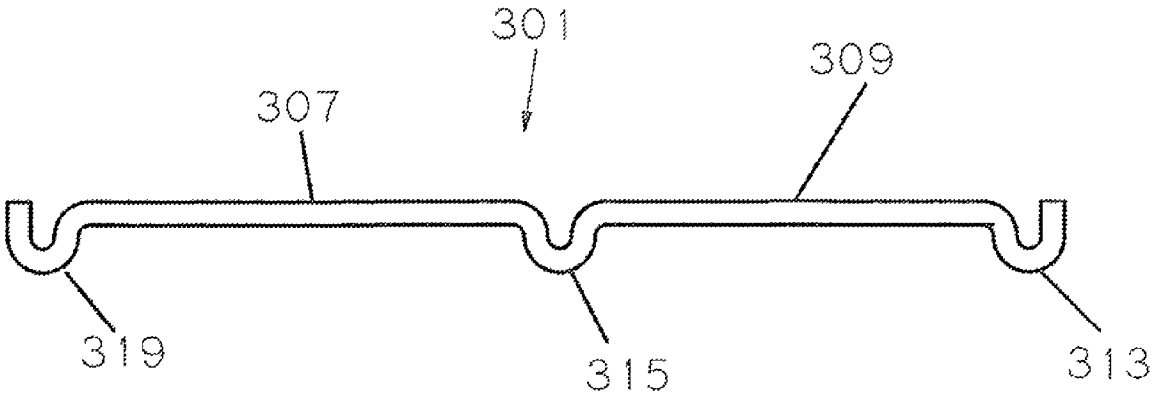
FIG. 12 is a side view of the shelf extension bracket of FIG. 11.

FIG. 11 presents an elevated, partial end view of an iteration of a wire shelf extension system comprising an extension bracket 301 and a wire shelf segment 305 attached to an existing wire shelf 300. Attention is also directed to FIG. 12 which depicts a side view of just the extension bracket 301 of FIG. 9. The extension bracket comprises a shaped rod having a fore end 309 in which a wire shelf segment 305 is to be placed and an aft end 307 for securing the extension bracket 301 and, hence, the wire shelf segment 305, to an existing wire shelf 300 having an intermediate support wire 306. The fore end of the extension bracket has a first "U" shaped cup or recess 313 at or near its free end and a second "U" shaped cup or recess 315 a distance removed from the first cup or recess wherein the distance corresponds to spread from the first support wire 316 to the second or back support wire 317 of the wire shelf segment 305. Although not shown, the fore end of the extension bracket may have a third or fourth cup or recess, each spaced from the first recess 313 to accommodate wire shelf segments of differing widths. Although FIG. 12 appears to show a clear demarcation between the fore and aft sections of the extension bracket, no such clear demarcation exists. Specifically, in the case of an extension bracket having three or more recesses for accommodating the support wires of different width wire shelf segments, it is possible that in use, particularly where the wire shelf segment is narrow in width, one or more of the recesses furthest removed from the first recess 313 may be on the aft side of the first support wire 304 of the existing shelf 300. In this case, those recesses aft of the first support wire are part of the aft end of the extension bracket whereas if the wire shelf segment is wide and employs the recess furthest removed from the first recess 303, that recess is forward of the first support wire 304 and the recess is part of the fore section of the extension bracket.

The aft section 307 of the extension bracket 301 comprises an elongated body have a "U" shaped cup or a recess 319 at or near the free end of the aft portion of the extension bracket. This cup or recess, as in the previous embodiments, serves as a seat for the intermediate support wire 306. As discussed above, the aft section of the extension bracket may employ and embody any of the iterations and alterations noted above for the extended segments of the extension stringer wires of the first and second embodiment.

Although the extension bracket may have a diameter or width that is the same as the stringer wires 321 of the wire shelf segment or the stringer wires 322 of the existing shelf, preferably, as shown, they have a somewhat greater diameter or width to allow for added strength. And, although not shown, these brackets may also have a scalloped recess in the underside of the aft portion of the extension bracket which coincide with the first support wire of the existing shelf so that the bracket will sit lower along the surface of the existing shelf in use.

Figure 13:
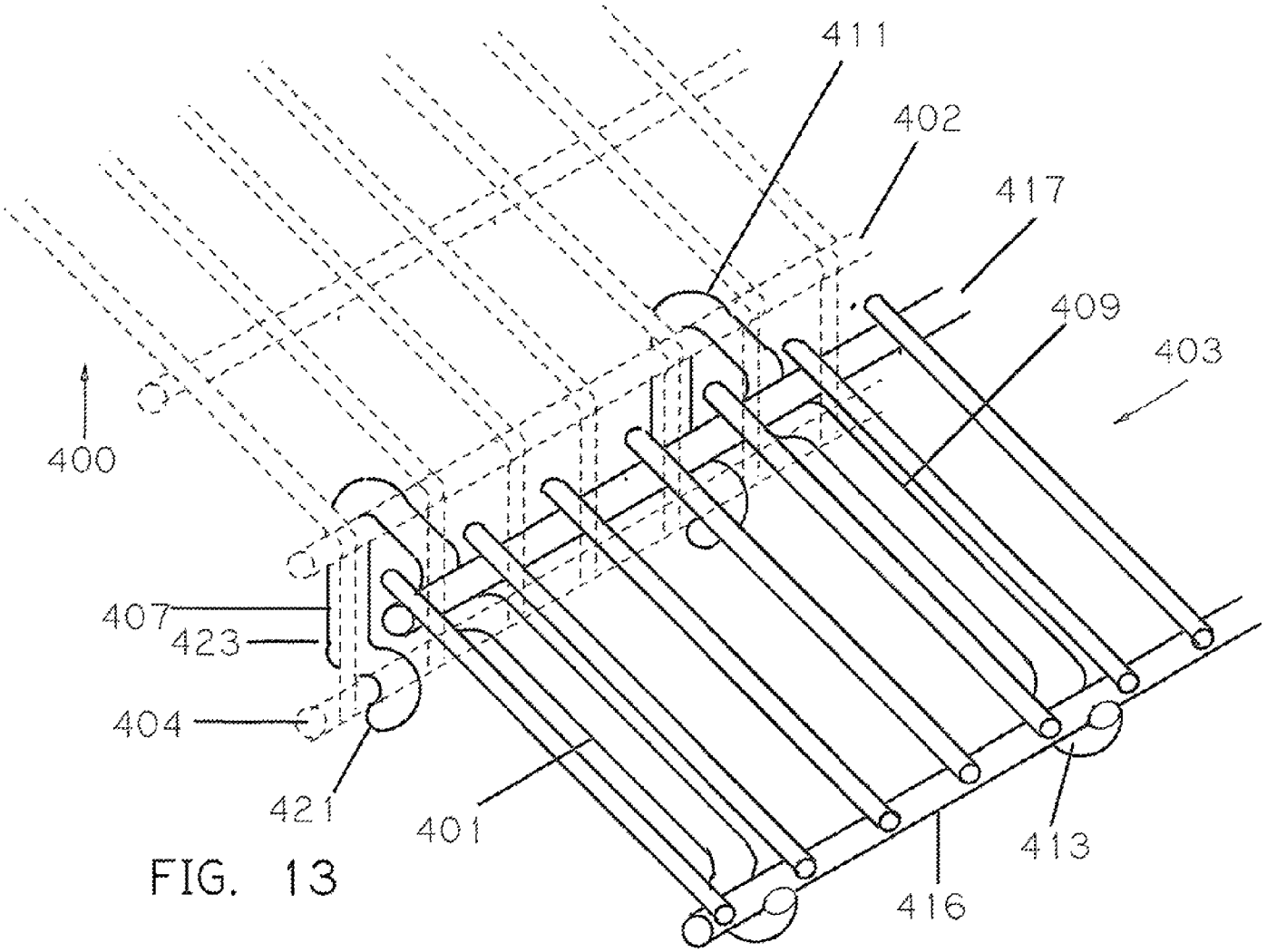
FIG. 13 is an elevated partial view of a shelf extension bracket and shelf segment according to the fifth embodiment.

FIG. 13 presents an elevated, partial end view of an iteration of a wire shelf extension system comprising an alternate extension bracket 401 and a wire shelf segment 403 attached to an existing wire shelf 400. Attention is also directed to FIG. 14 which depicts a side view of just the extension bracket 401 of a variant of the extension bracket of FIG. 13. The extension bracket comprises a shaped rod having a fore end 409 in which a wire shelf segment 403 is to be placed and an aft end 407 for securing the extension bracket 401 and, hence, the wire shelf segment 403, to an existing wire shelf 400. The fore end of the extension bracket has a first "U" shaped cup or recess 413 at or near its free end and a second "U" shaped cup or recess 415 a distance removed from the first cup or recess wherein the distance corresponds to the spread from the first support wire 416 to the second or back support wire 417 of the wire shelf segment 403. Although not shown, the fore end of the extension bracket may have a third or fourth cup or recess, each spaced from the first recess 413 to accommodate wire shelf segments of differing widths. In this case, depending upon which recesses the wire shelf segment is situated in, there may be gaps between the existing shelf and the wire shelf segment or, if not, then the fore ends of the extension brackets will extend beyond the front edge of the shelf extension.

Figure 14:
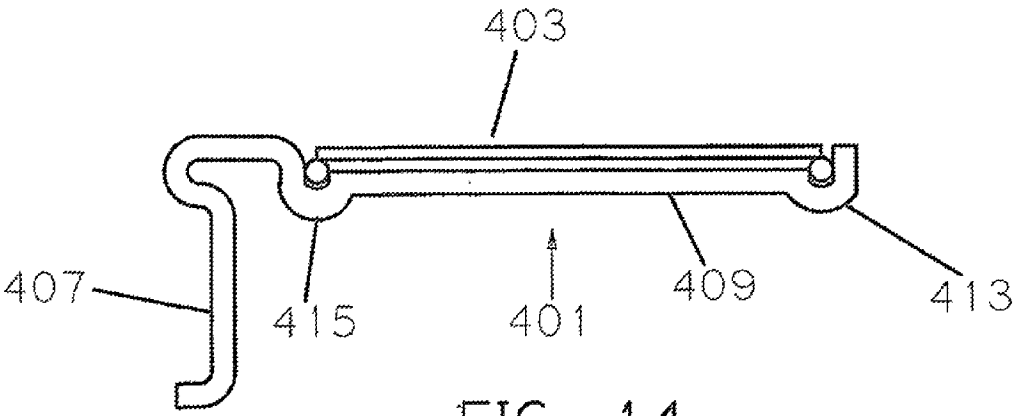
FIG. 14 is a side view of a variant of the shelf extension bracket of FIG. 13.

The aft section 407 of the extension bracket 401 otherwise mimics in all respects and iterations the extended segment of the extension stringer wires of the third embodiment and those embodiments shown in FIGS. 8, 9 and 10. Specifically, in FIG. 13, the fore end 411 of the aft section of the extension bracket bends around the first support wire 402 of the existing shelf 400 at a right angle and extends to the spaced support wire 404 of the existing shelf. The free end of the aft portion of the extension bracket 407 is configured to present a seat 421 for the spaced support wire 404. Specifically, as shown in FIG. 13, the end portion of the aft section of the extension bracket is bent at a right angle back towards the body of the extension bracket for a distance before it is then bent in a "C" like shape 421 that is sized to receive the spaced support wire. The aforesaid distance is selected so that fore section of the extension bracket is parallel with the stringer wires of the existing shelf 400. Alternatively, as shown in FIG. 14, the initial bend in the fore end 411 of the aft section of the extension bracket is configured to fully seat the first support wire 402 before it is then bent in the opposite direction at a right angle so that the remaining portion of the aft portion of the extension bracket 407 is perpendicular to the fore section of the extension bracket and extends to the fore face of the spaced support wire. In this embodiment, it is not necessary that the foot of the "J" fully captures the spaced support wire.

Figure 15:
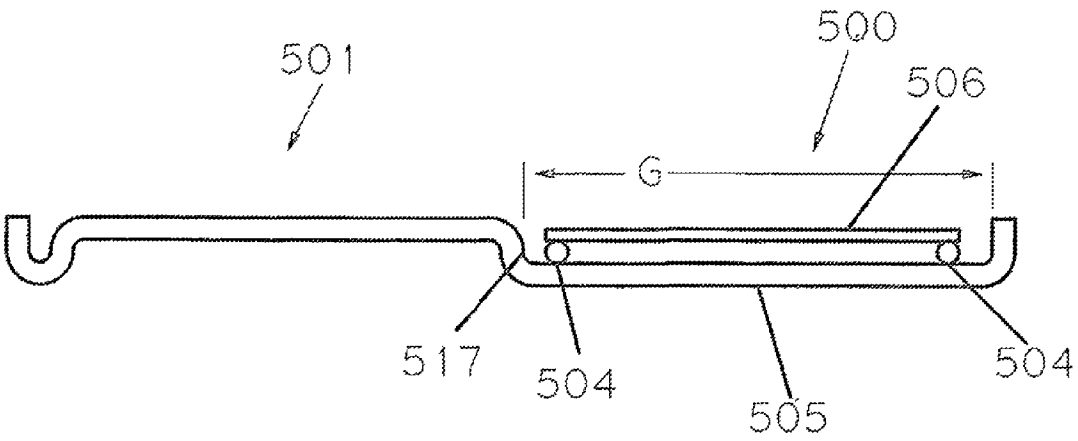
FIG. 15 is a side view of an alternate version of a shelf extension bracket and shelf segment according to the fourth embodiment.
Figure 16:
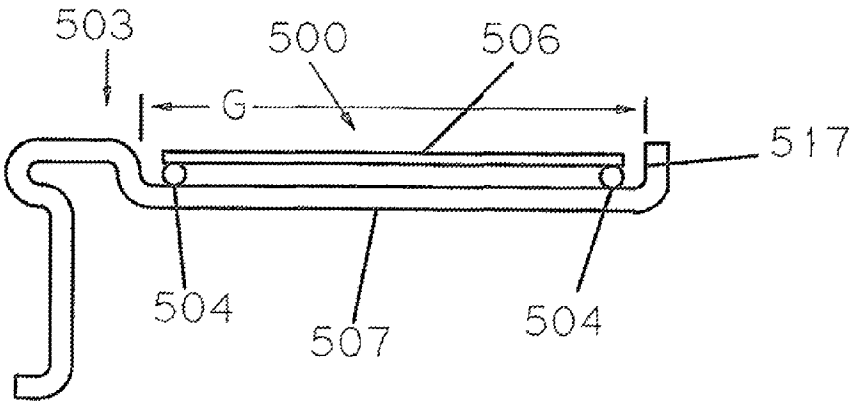
FIG. 16 is a side view of an alternate version of a shelf extension bracket and shelf segment according to the fifth embodiment.
Figure 18:
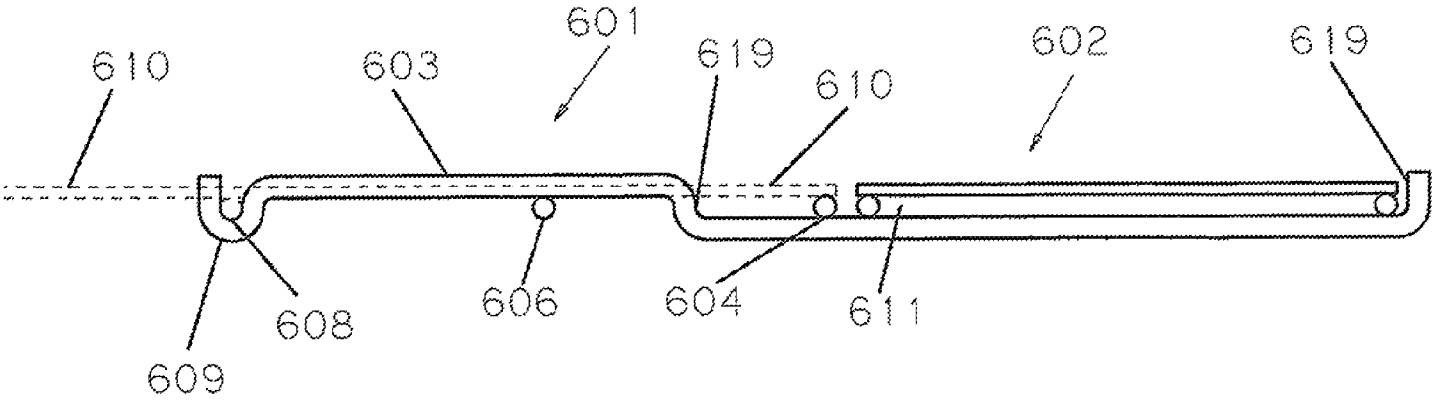
FIG. 18 is a side view of the shelf extension bracket of FIG. 17 holding a narrow shelf segment.
Figure 17:
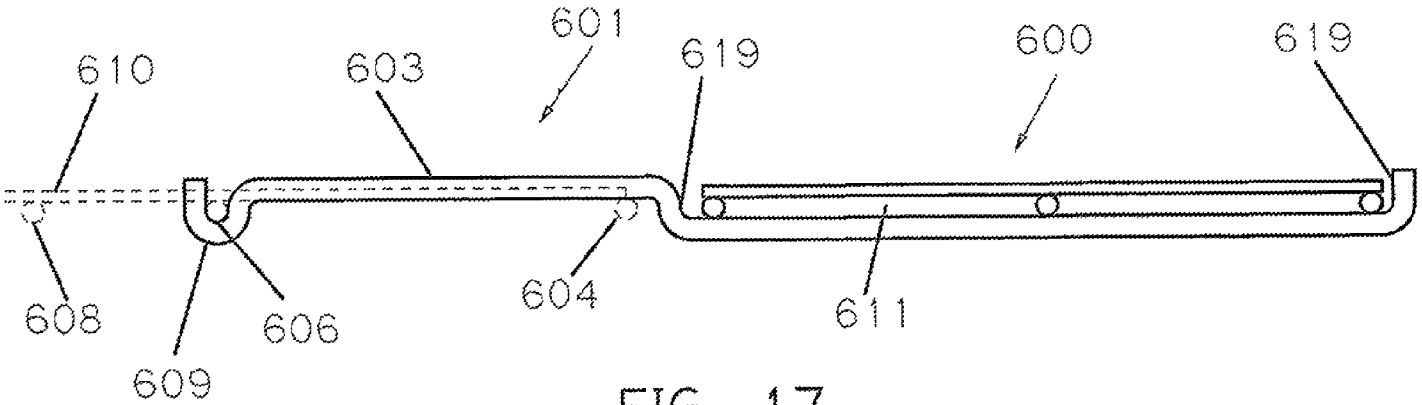
FIG. 17 is a side view of an alternate version of a shelf extension bracket and wide shelf segment according to the fourth embodiment.

FIGS. 15 and 16 present the extension brackets 501/503 of the fourth and fifth embodiments wherein the fore section 505/507 of each extension bracket is in the shape of a tray or, more appropriately, the cross-section of a tray, in which, in use, a wire shelf segment 500 is to sit. Preferably, in each embodiment, the depth of the tray as defined by the side walls 517 is such that the combined height of the wire segment support wires 504 and the wire segment stringer wires 506 will be such that the upper surface of the wire segment stringer wires is coplanar or nearly coplanar with the top of the aft side wall 517 and/or coplanar or nearly coplanar with the surface of the shelf to which it is attached. The width of the tray G is sized to accept a given wire width of a shelf segment and/or may be oversized to account for small variations in standard widths of different manufacturers. Specifically, as shown in FIGS. 17 and 18, an extension bracket 601 may have an elongated tray portion 611 which is capable of accepting either a wide wire shelf segment 600 or a narrow wire shelf segment 602. In each of these figures, the existing wire shelf 610 has a front support wire 604 and two intermediate support wires 606/608. As shown in FIG. 17 when the wide wire segment 600 is employed the cup or recess 609 of the aft end 603 of the bracket extension 601 engages the forward intermediate support wire 606. In this embodiment, the wide wire segment 600 is secured in the tray 611 of the bracket by tray walls 619. As shown in FIG. 18, when a narrow wire segment 602 is employed the cup or recess 609 engages the aft intermediate support wire 608 and the first support wire 604 sits in the tray 611 of the fore section of the extension bracket. In this embodiment, the narrow wire segment 602 is held in place by the fore wall 619 of the tray and the fore end of the existing wire shelf 610. Of course, it is to be appreciated that the narrow wire segment could be situated in the tray as shown in FIG. 17; however, that wire segment would be free to move forward and backward in the tray absent means to secure it in place. With respect to the latter, the upper surface of the extension bracket in the tray could have one or more recesses or stops (e.g., one or more ridges in the upper surface bracket in the tray) to prevent the sliding of the wire shelf segment in the tray.

Figure 20:
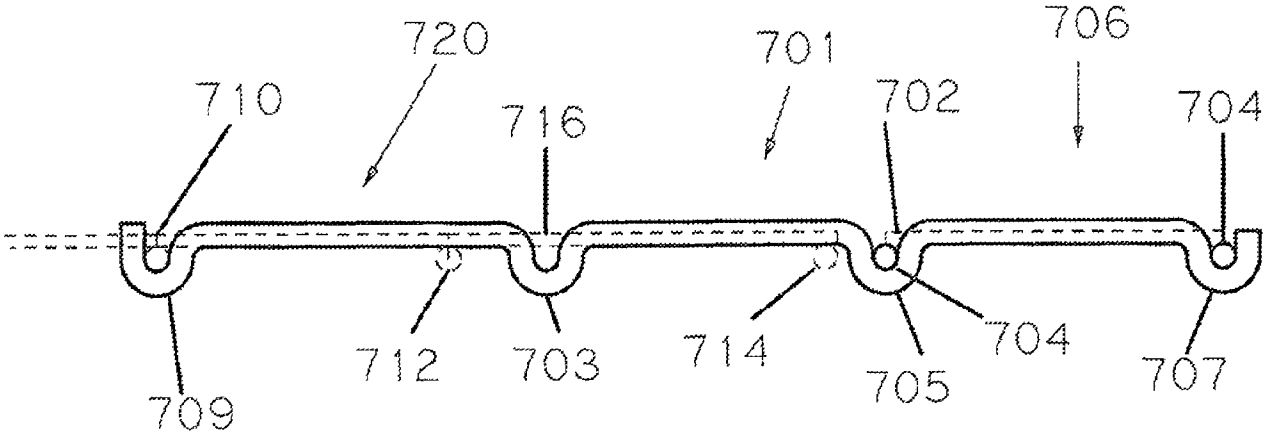
FIG. 20 is a side view of the shelf extension bracket of FIG. 19 holding a narrow width wire shelf segment.
Figure 19:
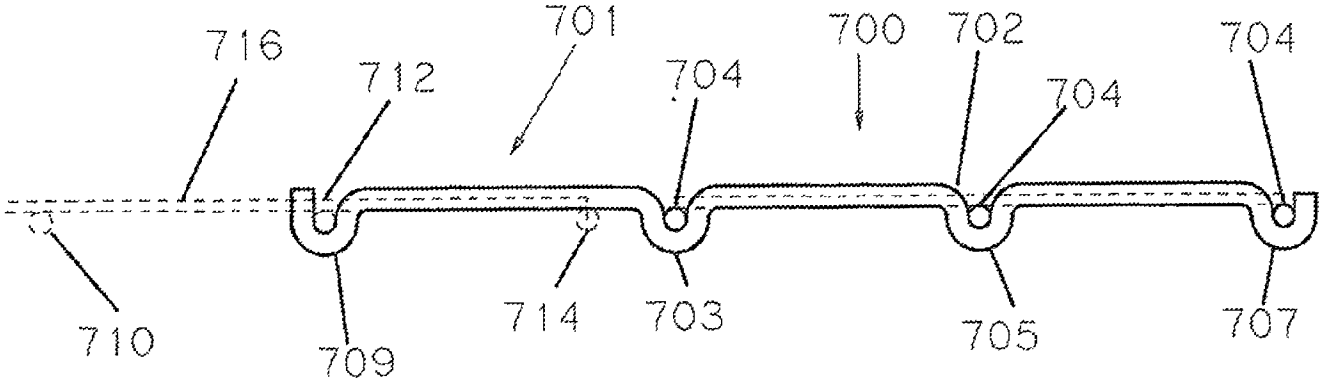
FIG. 19 is a side view of yet another alternative of a shelf extension bracket holding a wide wire shelf segment according to the fourth embodiment.

FIGS. 19 and 20 present an alternate extension bracket 701 wherein fore section is extended so as to allow for receipt of wire shelf segments 700/706 of wide and narrow widths without having to change out the extension bracket. FIG. 19 shows that embodiment wherein the fore section of the extension bracket holds a wide wire shelf segment 700 comprising three support wires 704 and stringer wires 702. The three support wires are held in fore recess 707, aft recess 703 and intermediate recess 705. The aft section of the extension bracket is held by an existing wire shelf 720 comprising, in succession, first support wire 714, fore intermediate support wire 712, aft intermediate support wire 710 and a back support wire, not shown, together with stringer wires 716. As shown, the aft section of the extension bracket 701 extends over the first support wire 714 and ends with a recess 709 in which the fore intermediate support wire 712 is held.

FIG. 20 shows the same extension bracket 701 however this time the fore section holds a narrow width wire shelf segment 706 comprising just two support wires 704 and the stringer wires 702. In this embodiment, the extension bracket 701 has been advanced into the existing shelf such that the recess 709 of the aft section of the extension bracket now seats the aft intermediate support wire 710, the fore intermediate support wire 712 is unseated, and the aft recess 703 of the fore section of the bracket now lies between the fore intermediate support wire 712 and the first or front support wire 714. The installation of the extension bracket for both embodiments shown in FIGS. 17 and 18 involves the same motion, i.e., the aft end of the extension bracket is inserted at an angle through the plane of the existing shelf surface and then the fore end of the extension bracket is lowered so that the extension bracket lies across the first or front support wire 714 except that in the case of the embodiment shown in FIG. 19, the aft end is inserted between the first support wire 714 and the fore intermediate support wire 712 and in the case of the embodiment shown in FIG. 20, the aft end is inserted between the fore and aft intermediate support wires 710/712.

Although the wire shelf extensions and extension bracket have been described with respect to specific embodiments and the appended drawings, it should be appreciated that the present teachings are not limited thereto and other embodiments utilizing the concepts expressed herein are intended and contemplated without departing from the scope of the present teaching as intended in the true spirit and scope of the invention. It is therefore intended that any and all modifications, variations, or equivalents that fall within the spirit and scope of the underlying principles are within the scope of this invention and are covered by the appended claims.

I claim:

1. A wire shelf extension adapted to be attached in a self-supporting manner to an outward facing edge of an existing wire shelf having a length, a width, a front edge and a back edge and comprising a plurality of support wires having upper and lower surfaces extending the length of the wire shelf and a plurality of stringer wires overlaying and attached to the support wires and extending the width of the shelf from the front edge of the shelf to the back edge of the shelf and defining a support surface of the wire shelf, the front edge and the back edge defined by support wires, said wire shelf extension having a width and a length and comprising a plurality of shelf extension support wires extending lengthwise of said shelf extension and a plurality of shelf extension stringer wires extending widthwise of said shelf extension, wherein said shelf extension stringer wires i) have upper and lower surfaces, the upper surfaces of which provide a shelf surface upon which items are to be placed in use, ii) are affixed to and overlay the shelf extension support wires in a generally perpendicular orientation and iii) extend from a first shelf extension support wire, which constitutes the front edge extension support wire, to a second shelf extension support wire, which constitutes the back extension support wire, provided that at least two of the shelf extension stringer wires are elongated stringer wires having extended segments that a) extend past the back extension support wire a distance that is at least the same distance as between the front support wire of the existing wire shelf and an adjacent support wire of the existing wire shelf to which it is to be attached and at most a distance that is the same as the width of the existing wire shelf to which the wire shelf extension is to be attached and b) have a free end; wherein, in use, the extended segments of the wire shelf extension lie over the upper surface of the support wire of the front edge of the existing wire shelf and engage the lower surface of another support wire in the support surface of the existing shelf such that the combined interaction of the extended segment with the support wire of the front edge of the existing wire shelf and the other support wire of the existing shelf allows the wire shelf extension to be self-supporting on the existing wire shelf.

2. The wire shelf extension of claim 1 wherein the extended segments extend linearly from and co-axially with the stringer wires.

3. The wire shelf extension of claim 2 wherein the extended segments are from 2 to 12 inches in length.

4. The wire shelf extension of claim 2 wherein at least one recess is present in the upper surface of each of the extended segments of the stringer wires.

5. The wire shelf extension of claim 4 wherein a plurality of recesses are present in the upper surface of each extended segment, one of which is at the free end of the extended segments.

6. The wire shelf extension of claim 2 wherein the extended segments are from 1 to 12 inches in length.

7. The wire shelf extension of claim 2 wherein the, extended segments are from 4 to 8 inches in length.

8. The wire shelf extension of claim 1 where not all of the shelf extension stringer wires have extended segments.

9. The wire shelf extension of claim 8 wherein the shelf extension stringer wires with extended segments are of a greater diameter or thickness than those shelf extension stringer wires which do not have extended segments.

10. The wire shelf extension of claim 1 wherein the shelf extension further comprises one or more support wires intermediate the first and second shelf extension support wires.

11. The wire shelf extension of claim 1 wherein there is at least one recess in the upper surface of the extended segments of the shelf extension stringer wires either at the free end of the extended segment or along the length of the extended segment or both, said at least one recess having a width and a depth adapted to seat, at least partially, a support wire of an existing wire shelf to which the wire shelf extension is to be attached

12. The wire shelf extension of claim 1 wherein the stringer wires having an extended segment are spaced every 4 to 6 inches along the length of the wire shelf extension.

13. The wire shelf extension of claim 1 wherein each extended segment has a recess in its upper surface at or near its free end.

* * * * *